US012162658B2

(12) United States Patent
Shukla et al.

(10) Patent No.: US 12,162,658 B2
(45) Date of Patent: Dec. 10, 2024

(54) PRESSURE RELIEF ASSEMBLIES AND METHODS

(71) Applicant: Illinois Tool Works Inc., Glenview, IL (US)

(72) Inventors: Umang Shukla, Jenison, MI (US); Jeremy Mead, Decatur, AL (US); Elizabeth Dietrich, Huntsville, AL (US); Vishwatej Mane, Allendale, MI (US); Brennen Auerbach, Tuscumbia, AL (US); Fiorella McNamara, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 78 days.

(21) Appl. No.: 17/991,115

(22) Filed: Nov. 21, 2022

(65) Prior Publication Data

US 2023/0159237 A1 May 25, 2023

Related U.S. Application Data

(60) Provisional application No. 63/282,067, filed on Nov. 22, 2021.

(51) Int. Cl.
*B65D 51/16* (2006.01)

(52) U.S. Cl.
CPC ..... *B65D 51/16* (2013.01); *B65D 2205/00* (2013.01)

(58) Field of Classification Search
CPC ..... B65D 51/16; B65D 51/1633; B65D 2205/00; B65D 2205/02
See application file for complete search history.

(56) References Cited

U.S. PATENT DOCUMENTS 4,003,505 A 1/1977 Hardt
4,416,338 A 11/1983 Nelson et al.
4,433,791 A * 2/1984 Mulawski ..... B05B 15/14 222/397
4,580,690 A 4/1986 Mulawski
4,803,136 A 2/1989 Bowsky et al.
(Continued)

FOREIGN PATENT DOCUMENTS

CN 106115089 A 11/2016
DE 19636876 C1 * 10/1997 ..... B65D 51/1638
(Continued)

OTHER PUBLICATIONS

PCT/US2022/050665—International Search Report and Written Opinion, dated May 23, 2023 (15 pages).

*Primary Examiner* — Javier A Pagan
(74) *Attorney, Agent, or Firm* — Quarles & Brady LLP

(57) ABSTRACT

The present disclosure generally relates to a venting system that includes a lid or base with a center wall that defines a central longitudinal axis, and a total radius that is measured from the longitudinal axis to an outermost surface of the lid or base. The venting system further includes a pressure relief feature that is disposed along the lid or base. The pressure relief feature includes at least a first venting feature defining a thinned region of the lid or base, a venting radius is measured from the longitudinal axis to an outermost extent of the first venting feature, and the venting radius is between about 5% and about 25% of the total radius of the lid or base.

20 Claims, 27 Drawing Sheets

(56) References Cited

U.S. PATENT DOCUMENTS

| | | | |
|---|---|---|---|
| 5,513,767 | A | 5/1996 | Daehn |
| 7,222,757 | B2 | 5/2007 | Ferreira et al. |
| 9,499,330 | B2 | 11/2016 | Henry et al. |
| 9,651,161 | B2 | 5/2017 | Colm et al. |
| 2013/0020320 | A1 | 1/2013 | Ferreira et al. |
| 2022/0041352 | A1 | 2/2022 | Prymula et al. |

FOREIGN PATENT DOCUMENTS

| | | | |
|---|---|---|---|
| JP | 2008159313 | A | 7/2008 |
| WO | 2018138226 | A1 | 8/2018 |
| WO | 2022240388 | A1 | 11/2022 |

* cited by examiner

PRESSURE RELIEF ASSEMBLIES AND METHODS

CROSS REFERENCE TO RELATED APPLICATIONS

This application claims the benefit of U.S. Provisional Application No. 62/282,067, filed on Nov. 22, 2021, and entitled "PRESSURE RELIEF ASSEMBLIES AND METHODS," the entire contents of which is incorporated by reference herein in its entirety.

FIELD OF EMBODIMENTS OF THE DISCLOSURE

The present disclosure relates to lids or bases for containers with one or more pressure relief features to allow for venting and depressurization of the container.

BACKGROUND

Various types of containers or canisters are utilized to retain or hold contents that may be initially pressurized or may become pressurized over time. For example, aerosol canisters may be pressurized with an aerosol, and may retain this initial pressurization until a user causes aerosol to be released, thereby reducing the pressure within the aerosol canister. In some instances, a container may be pressurized, and may maintain the initial level of pressurization throughout the life cycle of the contents of the container. In still other instances, a container may become pressurized over time due to one or more factors that cause the container to become pressurized, such as a chemical reaction that occurs within the container.

In any of the aforementioned pressurization situations, one or more features may be built into or along one or more portions of the container, which may allow for venting of the container in the event that venting becomes necessary. In the scenario where pressure within the container increases after the container has been initially sealed, a venting feature may be included to prevent over-pressurization of the container, which could result in an uncontrolled release of contents from within the container.

While various venting features exist that provide for venting or depressurization of containers that include contents that become pressurized over time, improved devices and methods are needed that can allow for more controlled depressurization based on pre-determined factors associated with the contents of a particular container.

SUMMARY

Embodiments of the present disclosure generally relate to a venting system that includes a lid or base comprising a center wall that defines a central longitudinal axis, and a total radius that is measured from the longitudinal axis to an outermost surface of the lid or base, and a pressure relief feature that is disposed along the lid or base. The pressure relief feature includes at least a first venting feature defining a thinned region of the lid or base, a venting radius is measured from the longitudinal axis to an outermost extent of the first venting feature, and the venting radius is between about 5% and about 25% of the total radius of the lid or base, expressed as a percentage.

In some embodiments, the pressure relief feature further includes a second venting feature that also defines a thinned region of the lid or base. In some embodiments, the first venting feature and the second venting feature are concavely shaped with respect to the longitudinal axis. In some embodiments, the first venting feature and the second venting feature are convexly shaped with respect to the longitudinal axis. In some embodiments, the first venting feature is a mirror image of the second venting feature. In some embodiments, the first venting feature and the second venting feature define a v-shape.

In some embodiments, the venting system further includes a third venting feature that also defines a thinned region of the lid or base. In some embodiments, the first venting feature, the second venting feature, and the third venting feature define a v-shape. In some embodiments, the first venting feature consists of a circular notch that is disposed only on an underside of the lid or base. In some embodiments, the venting radius is between about 10% and about 22% of the total radius of the lid or base.

In some embodiments, a venting system includes a lid or base comprising a center wall that defines a central longitudinal axis, and a total radius that is measured from the longitudinal axis to an outermost periphery of the lid or base, and a pressure relief feature that is disposed along the lid or base. In some embodiments, the pressure relief feature includes at least a first venting feature defining a thinned region of the lid or base, a venting radius is measured from the longitudinal axis to an outermost extent of the first venting feature, the venting radius is less than about 40% of the total radius of the lid or base, expressed as a percentage, and the thinned region defines a region thickness that is less than about 40% of a maximum thickness of the central wall, expressed as a percentage.

In some embodiments, the pressure relief feature further includes a second venting feature that is spaced from the first venting feature. In some embodiments, the first venting feature and the second venting feature are mirror images of one another. In some embodiments, the first venting feature and the second venting feature define curved segments. In some embodiments, the first venting feature and the second venting feature define a v-shape. In some embodiments, the pressure relief feature further includes a third venting feature. In some embodiments, the thinned region extends through the central longitudinal axis. In some embodiments, the first venting feature defines an s-shape. In some embodiments, a minimum venting distance of the pressure relief feature is less than about 20% of the total radius of the lid or base. In some embodiments, a minimum venting distance of the pressure relief feature is less than about 50% of the total radius of the lid or base.

DETAILED DESCRIPTION

Figure 1:
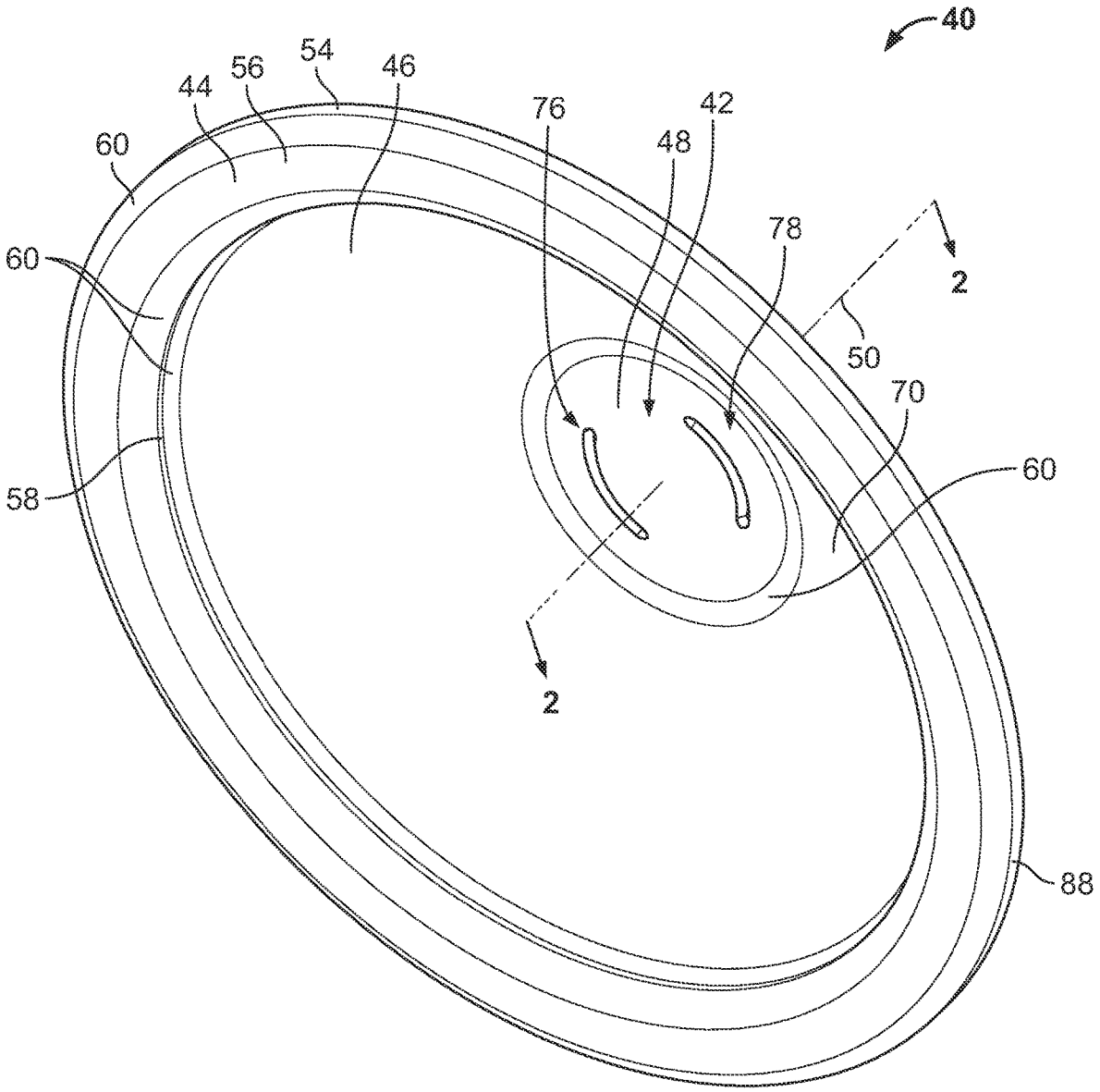
FIG. 1 is a bottom isometric view of a lid or base for a container, the lid or base having a first embodiment of a pressure relief feature.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Throughout the disclosure, the terms "about" and "approximately" mean plus or minus 5% of the number that each term precedes.

Embodiments of the present disclosure provide for a lid or base that is coupled with or forms a container. The lid or base may comprise a lid, plate, or another type of closure for enclosing contents within the container, the lid or base having one or more pressure relief or venting features that allow for controlled and targeted pressure relief when a maximum pressure threshold has been achieved within the container. Upon reaching a maximum pressure, the lid or base ruptures at one or more locations along the respective pressure relief feature(s) to allow for depressurization. The venting or pressure relief features described herein may be implemented in a wide variety of technologies, including applications related to aerosol containers, battery cell containers, capacitors, fuel storage reservoirs, and pressure vessels. In each of the aforementioned applications, pressure release may be required due to pressure build-up within the container, and the venting features disclosed herein may allow for depressurization or expulsion once a maximum pressure threshold has been reached.

Through finite element analyses (FEA) of various pressure relief feature configurations, certain configurations and orientations of pressure relief vents have been found to provide highly localized and targeted pressure relief once a maximum pressure threshold has been reached within the container. The present disclosure includes various configurations of pressure relief features on a circular lid or base that are configured to rupture once a maximum pressure threshold has been achieved. The maximum pressure threshold for the various configurations described herein may be different based upon the location, spacing, and number of the pressure relief features disposed along the lid or base. However, all of the pressure relief features disclosed herein are disposed entirely within a venting radius that is greater than 10% and less than 25% of a total radius of the lid or base, measured from a central longitudinal axis of the lid or base. By providing the venting features discussed hereinafter below, controlled and targeted pressure relief can be achieved at locations that are arranged spaced from a peripheral rim of the lid or base, and thus the container to which the lid or base is coupled.

Figure 2:
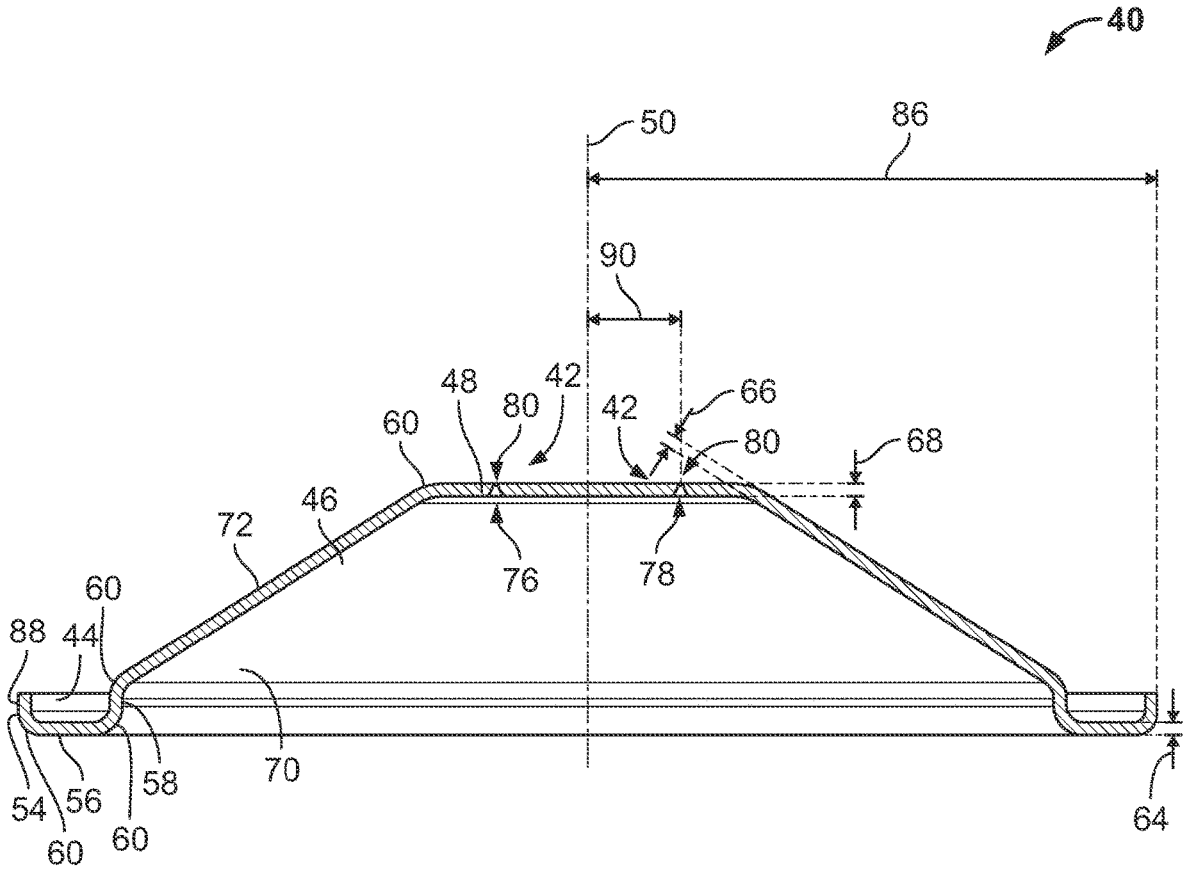
FIG. 2 is a cross-sectional, side view of the lid or base taken through line 2-2 of FIG. 1.

Referring in particular to FIGS. 1 and 2, a lid or base 40 having a first embodiment of a pressure relief feature 42 is shown. The lid or base 40 includes a first or outer wall 44 that is configured for engagement with a container (not shown), a second or intermediate wall 46 that extends radially upward and inward from the outer wall 44, and a third or central wall 48 that extends radially inward from the intermediate wall 46. The pressure relief feature 42 is provided within or along the central wall 48, and a central longitudinal axis 50 extends centrally through the central wall 48. Referring to FIG. 2, the outer wall 44 includes a first or outermost portion 54, a second or intermediate portion 56, and a third or innermost portion 58, the portions 54, 56, 58 of the outer wall 44 combining to define a U-shape in cross-section. The portions 54, 56, 58 are configured to be crimped or otherwise coupled with a container (not shown). The portions 54, 56, 58 are separated by corners or rounds 60 that define the various portions 54, 56, 58 of the outer wall 44. The intermediate wall 46 also intersects with the outer wall 44 at one of the corners 60 and extends inward at a constant angle until the intermediate wall 46 intersects with the central wall 48. The outermost portion 54 of the outer wall 44 also defines an outermost surface or rim that circumscribes a periphery of the lid or base 40.

Referring in particular to FIG. 2, the outer wall 44 defines an outer wall thickness 64, the intermediate wall 46 defines an intermediate wall thickness 66, and the central wall 48 defines a central wall thickness 68. In some embodiments, the central wall thickness 68, the intermediate wall thickness 66, and the outer wall thickness 64 may be the same or may be different. Still further, the portions 54, 56, 58 of the outer wall 44 may define the same thickness, or the thicknesses may be different. As discussed hereinafter below, a maximum thickness of the central wall thickness 68 is discussed below with respect to the various proportions of the pressure relief features 42 since all of the pressure relief features are disposed within the central wall 48. Further, a first or inner surface 70 and a second or outer surface 72 of the lid or base 40 are further shown in FIG. 2, and each extend along all of the outer wall 44, the intermediate wall 46, and the central wall 48. The outermost portion 54 of the outer wall 44 is also shown, which defines the outermost surface of the lid or base 40. Still further, unless otherwise specified, the lid or base 40 of FIGS. 1 and 2 is identical to the lid or base 40 of FIGS. 3-23.

Referring again to FIG. 1, the pressure relief feature 42 is shown in perspective, and includes a first venting feature or notch 76 and a second venting feature or notch 78, which is a mirror image of the first venting feature 76. The first venting feature 76 and the second venting feature 78 are both concavely curved with respect to the longitudinal axis 50. The first venting feature 76 and the second venting feature 78 each radially extend about 90° around the central longitudinal axis 50. In some embodiments, the first venting feature 76 and the second venting feature 78 may each extend around the central longitudinal axis 50 between about 30° and about 150°, or between about 60° and about 120°, or between about 75° and about 105° around the central longitudinal axis 50. In some embodiments, the first venting feature 76 and the second venting feature 78 may each extend less than about 150°, or less than about 140°, or less than about 130°, or less than about 120°, or less than about 110°, or less than about 100°, or less than about 90°, or less than about 80°, or less than about 70°, or less than about 60°, or less than about 50°, or less than about 40°, or less than about 30°, or less than about 20°, or less than about 10° around the longitudinal axis 50.

Referring to FIG. 2, the pressure relief feature 42 is shown in cross section and is generally located in or along the central wall 48 of the lid or base 40. As noted above, the pressure relief feature 42 includes the first venting feature 76 and the second venting feature 78, and defines thinned regions 80 between the inner surface 70 and the outer surface 72, which are configured to rupture to release pressure from the lid or base 40, if necessary. As discussed below and shown in detail in FIGS. 24A-27B, the thinned regions 80 each have a region thickness 82 that is less than about 20% of the maximum thickness of the central wall thickness 68, and comprise one or more of the notch profiles discussed below. In some embodiments, the region thickness 82 may vary along one or both of the first venting feature 76 and the second venting feature 78. In some embodiments, the region thickness 82 of the first venting feature 76 is larger than the region thickness 82 of the second venting feature 78. In some embodiments, the region thickness 82 may increase between first and second ends of the first or second venting features 76, 78. By varying the region thickness, the pressure relief feature 42 can be tuned or controlled for a programmable rupture. The characteristics of the region thickness 82 of FIGS. 1 and 2 are applicable to all of the region thicknesses 82 of the pressure relief features 42 discussed below.

Still referring to FIG. 2, the central longitudinal axis 50 extends centrally through the central wall 48, and in the present embodiment, the lid or base 40 is symmetric about the central longitudinal axis 50 in at least two directions. In some embodiments, the lid or base 40 is symmetric about the longitudinal axis 50 in at least three, or four, or five, or more directions. The central longitudinal axis 50 is shown extending centrally through the lid or base 40, and a line segment or total radius 86 of the lid or base 40 is shown, being measured normal from the longitudinal axis 50 to an outermost surface 88 of the lid or base 40. Further, a venting radius 90 is shown, being measured normal from the longitudinal axis 50 to an outermost location of the pressure relief features 42. While the venting radius 90 is shown being less than about 18% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. The venting radius 90 may vary around the longitudinal axis 50, or the venting radius 90 may be a constant radius.

Figure 3:
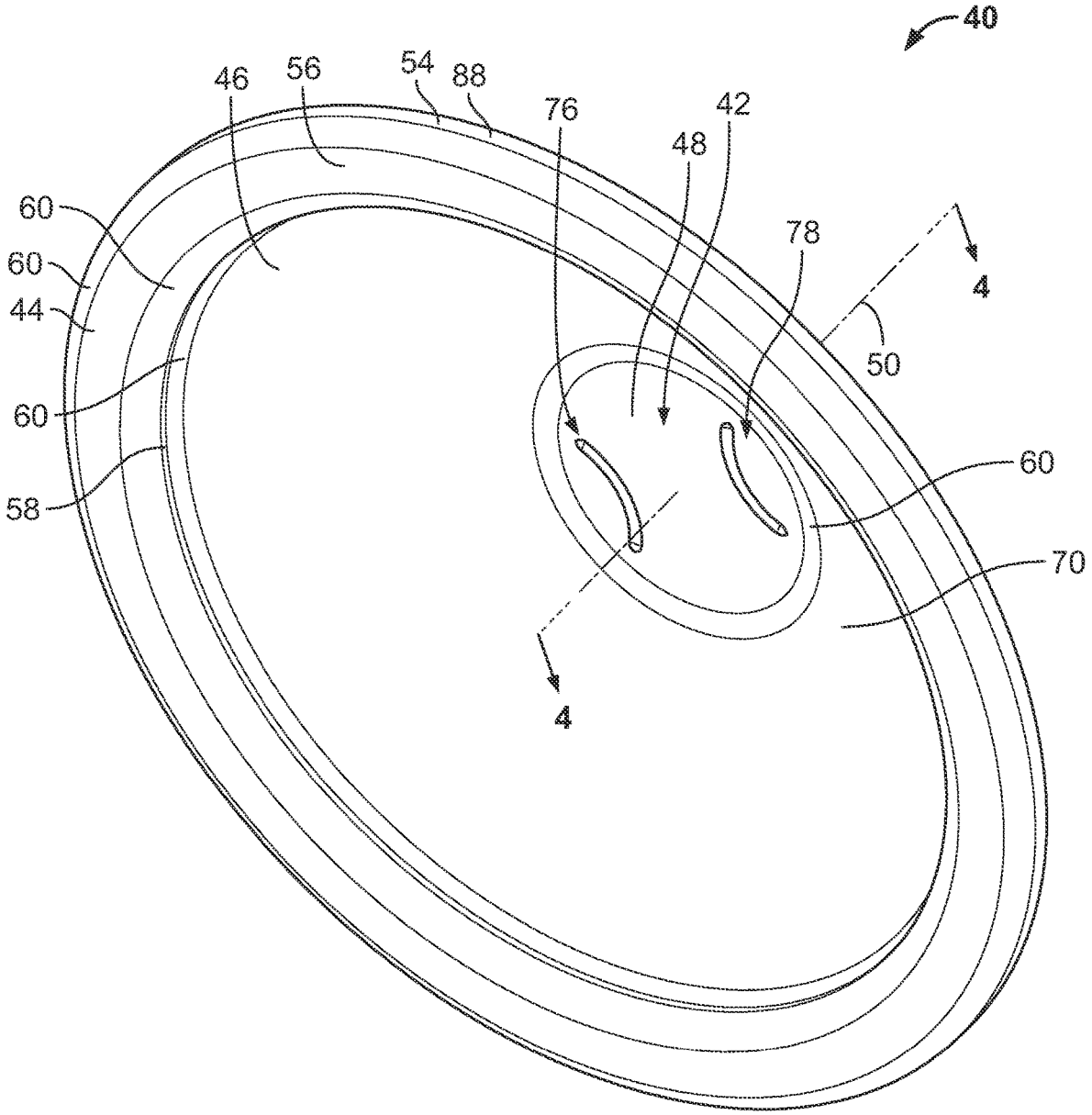
FIG. 3 is a bottom isometric view of a lid or base for a container, the lid or base having a second embodiment of a pressure relief feature.
Figure 4:
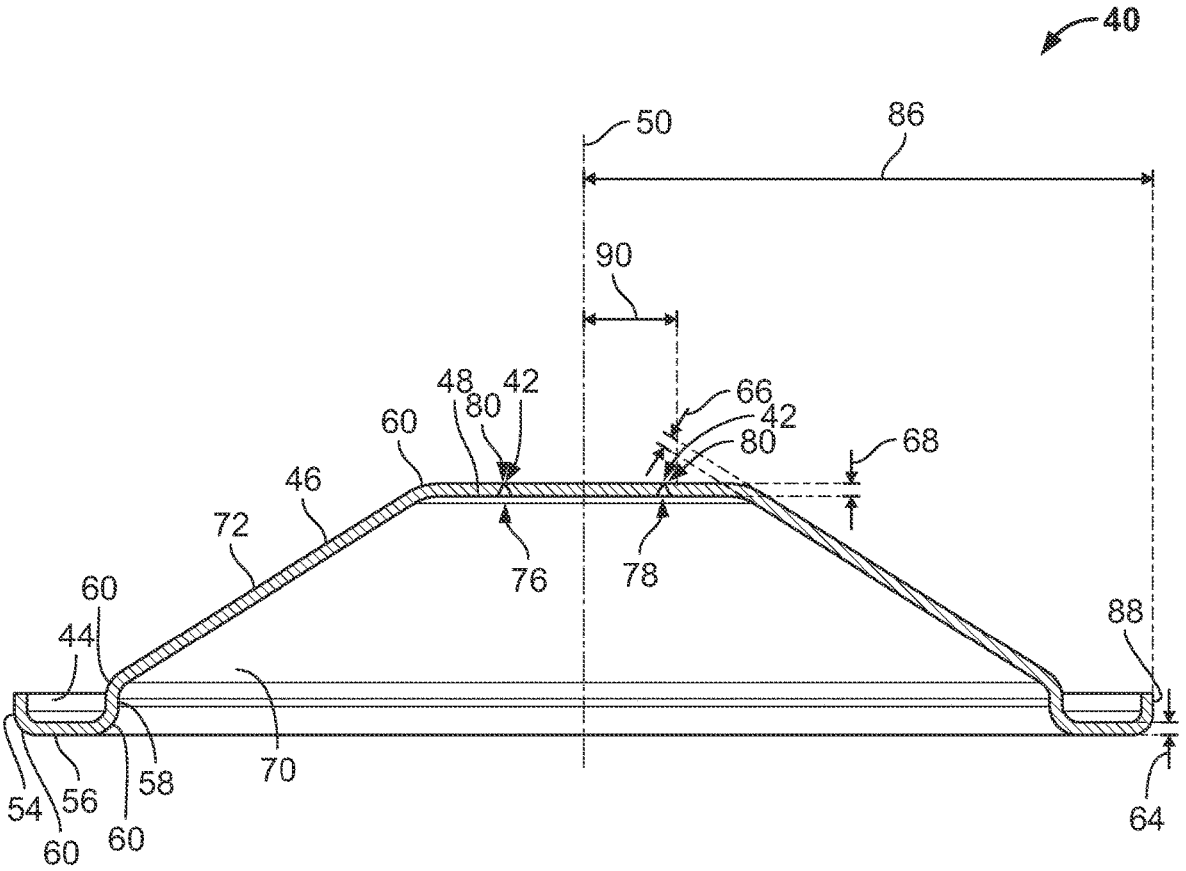
FIG. 4 is a cross-sectional, side view of the lid or base taken through line 4-4 of FIG. 3.

Referring now to FIGS. 3 and 4 the lid or base 40 is shown having a second embodiment of the pressure relief feature 42. In a similar fashion as described above with respect to FIGS. 1 and 2, the pressure relief feature 42 includes the first venting feature 76 and the second venting feature 78, which is a mirror image of the first venting feature 76. The first venting feature 76 and the second venting feature 78 are both convexly curved with respect to the central longitudinal axis 50. The first venting feature 76 and the second venting feature 78 each define an outwardly shaped curved arc, and each of the venting features radially extend about 90° around the longitudinal axis 50. In some embodiments, the first venting feature 76 and the second venting feature 78 may each extend around the central longitudinal axis 50 between about 30° and about 150°, or between about 60° and about 120°, or between about 75° and about 105° around the longitudinal axis 50. In some embodiments, the first venting feature 76 and the second venting feature 78 may each extend less than about 150°, or less than about 140°, or less than about 130°, or less than about 120°, or less than about 110°, or less than about 100°, or less than about 90°, or less than about 80°, or less than about 70°, or less than about 60°, or less than about 50°, or less than about 40°, or less than about 30°, or less than about 20°, or less than about 10° around the central longitudinal axis 50.

Referring to FIG. 4, the pressure relief feature 42 is shown in cross section and is generally located in or along the central wall 48 of the lid or base 40. The first venting feature 76 and the second venting feature 78 define thinned regions 80 between the inner surface 70 and the outer surface 72, which are configured to rupture to release pressure from the lid or base 40, if necessary. As shown in detail in FIGS. 24A-27B, the thinned regions 80 each have a region thickness 82 that is less than about 20% of the maximum thickness of the central wall thickness 68. As noted above, the region thickness 82 may be adjusted based on a desired performance of the pressure relief feature 42.

Still referring to FIG. 4, in the present embodiment, the lid or base 40 is symmetric about the central longitudinal axis 50 in at least two directions since the pressure relief features 42 are mirror images of one another. The longitudinal axis 50 is shown extending centrally through the lid or base 40, and the line segment or radius 86 of the lid or base 40 is shown, being measured normal from the longitudinal axis 50 to the outermost surface 88 of the lid or base 40. Further, the venting radius 90 is shown, which in the present embodiment is measured normal from the longitudinal axis 50 to an innermost location of the pressure relief features 42. In that sense, the venting radius 90 of the present embodiment is a minimum or inner venting radius, while the venting radius 90 of FIGS. 1 and 2 is measured as a maximum or outer venting radius. In some embodiments, such as the embodiments of FIGS. 5-12 discussed below, the venting radius 90 defines a constant radius around the longitudinal axis 50.

While the venting radius 90 of FIG. 4 is shown being less than about 16% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. The aforementioned distances are taken along the line segment or radius 86 in relation to the outermost surface 88 of the outer wall 44 taken along the particular line segment. In the present embodiment, the inner venting radius 90 varies around the longitudinal axis 50 since the first venting feature 76 and the second venting feature 78 are convexly disposed with respect to the central longitudinal axis 50.

The concavely and convexly shaped first and second venting features 76, 78 of FIGS. 1-4 are configured to allow for directional venting within a tight profile that extends in a direction of the central longitudinal axis 50. A venting cone (not shown) may be produced by the contents within the container once rupture has occurred, and the concavely/convexly shaped venting features 76, 78 provide for a venting cone having a lower cone angle. For example, the venting features 76, 78 may provide for a cone angle, i.e., an angle between the longitudinal axis and a leg of the cone, that is less than about 30°, or less than about 25°, or less than about 20°, or less than about 15°, or less than about 10°, or less than about 5°. The venting cone may be defined as a cone that comprises at least 95% of particles that are dispersed from the container through one or both of the venting features 76, 78.

Still further, the concavely and convexly shaped first and second venting features 76, 78 may be modified to allow for programmable, directional venting and may be configured for controlled venting in directions that are angled with respect to the central longitudinal axis 50. In particular, the concavely shaped venting features 76, 78 of FIGS. 1 and 2 allow for venting to occur via one or both of the venting features 76, 78 in a direction toward the longitudinal axis 50, i.e., an inward direction. The convexly shaped venting features 76, 78 of FIGS. 3 and 4 allow for venting to occur in a direction moving away from the central longitudinal axis 50, i.e., an outward direction. However, the location and disposition of all of the venting features 76, 78 of FIGS. 1-4 allow for a cone angle with a tight profile that allows for venting along the central longitudinal axis 50, and the concavity or convexity of the venting features allows for more targeted venting. Still further, an evacuation time of the contents from within the container may be controlled based on the disposition, size, and curvature of the venting features 76, 78.

Referring now to FIGS. 5-12, embodiments of the pressure relief feature 42 are shown applied to the lid or base 40. The pressure relief feature 42 of FIGS. 5-12 includes only the first venting feature 76, which is circular. The first venting features 76 of FIGS. 5-12 have centers that are collinear with the longitudinal axis 50. The first venting features 76 include the thinned region 80 between the inner surface 70 and the outer surface 72, the thinned region 80 being configured to rupture to release pressure from the lid or base 40, if necessary. The central wall thickness 68 and the region thickness 82 are similar or identical to those described above with respect to FIGS. 1 and 2 above. Referring in particular to FIGS. 5-7, 9, 10, and 12, the pressure relief feature 42 is formed continuously around the central wall 48 of the lid or base 40, i.e., 360° about the longitudinal axis 50. In contrast, and referring to FIGS. 8 and 11, the pressure relief feature 42 is disposed about 275° around the longitudinal axis. In some embodiments, the pressure relief feature 42 may be disposed between about 150° and about 350°, or about 200 and about 325°, or about 250° and about 300°, or about 260° and about 290° about the central longitudinal axis 50. In the present embodiment and referring to FIGS. 24A-27B, the thinned regions 80 each have a region thickness 82 that is less than about 20% of the maximum thickness of the central wall thickness 68. The region thickness 82 may be adjusted based on a desired performance of the pressure relief feature 42.

Figure 5:
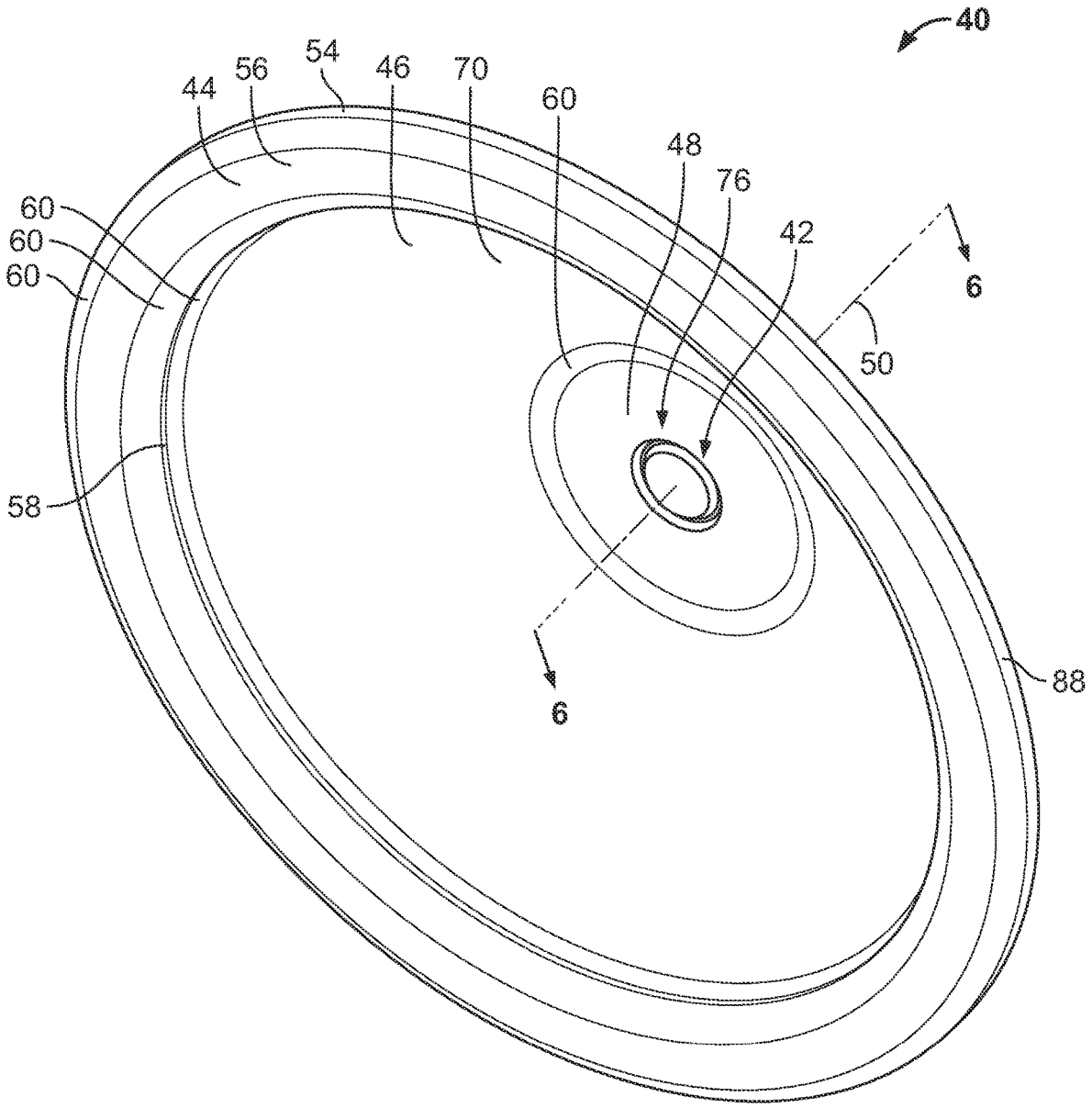
FIG. 5 is a bottom isometric view of a lid or base for a container, the lid or base having a third embodiment of a pressure relief feature.
Figure 6:
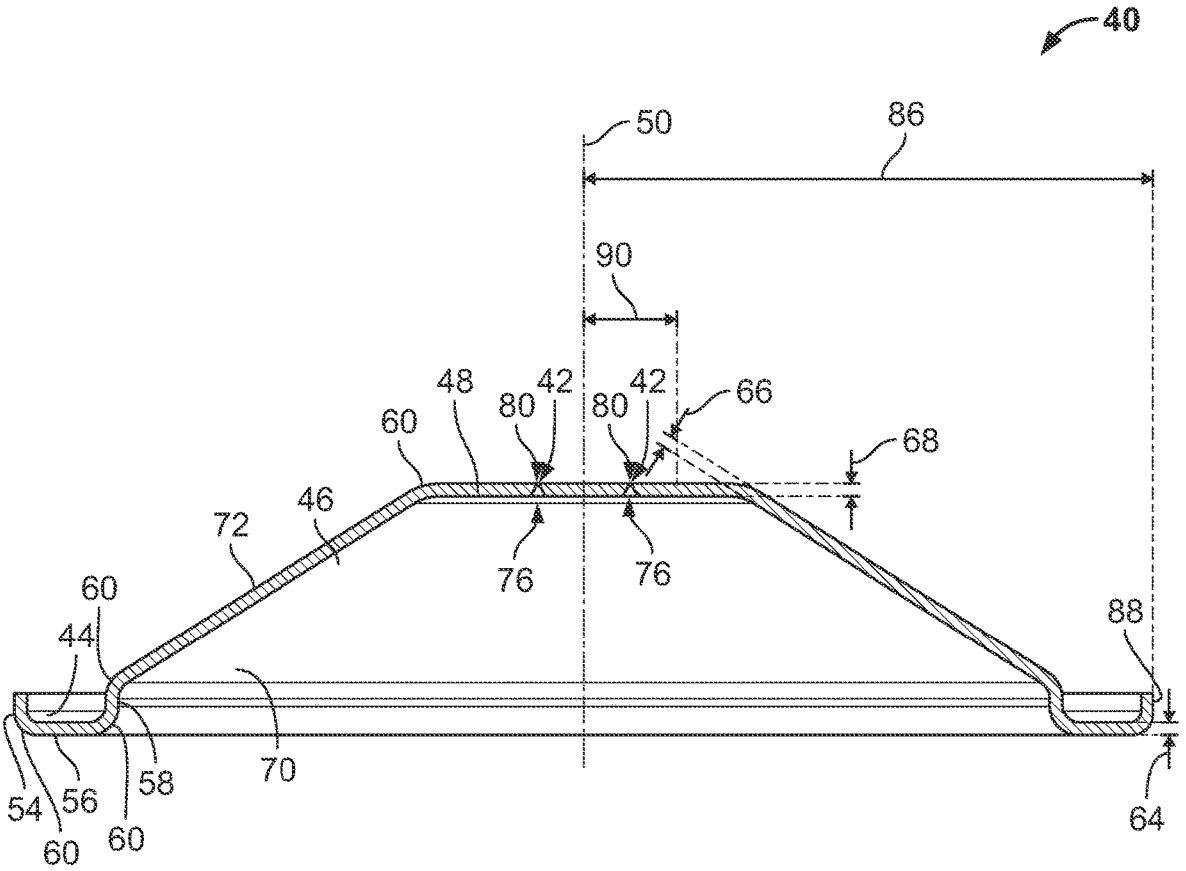
FIG. 6 is a cross-sectional, side view of the lid or base taken through line 6-6 of FIG. 5.

Referring in particular to FIGS. 5 and 6, the lid or base 40 and the pressure relief feature 42 are radially symmetric about the longitudinal axis 50 since the pressure relief feature 42 extends entirely around the longitudinal axis 50. The longitudinal axis 50 is shown extending centrally through the lid or base 40, and the line segment or total radius 86 of the lid or base 40 is shown, being measured normal from the longitudinal axis 50 to the outermost surface 88 of the lid or base 40. Further, the venting radius 90 is shown, being measured normal from the longitudinal axis 50 to a location of the pressure relief feature 42. Since the pressure relief feature 42 defines a circle, the venting radius 90 is constant around the entire longitudinal axis 50. While the venting radius 90 is shown being less than about 11% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. In the present embodiment, the venting radius 90 is constant around the longitudinal axis 50 since the first venting feature 76 defines the shape of a circle.

Figure 7:
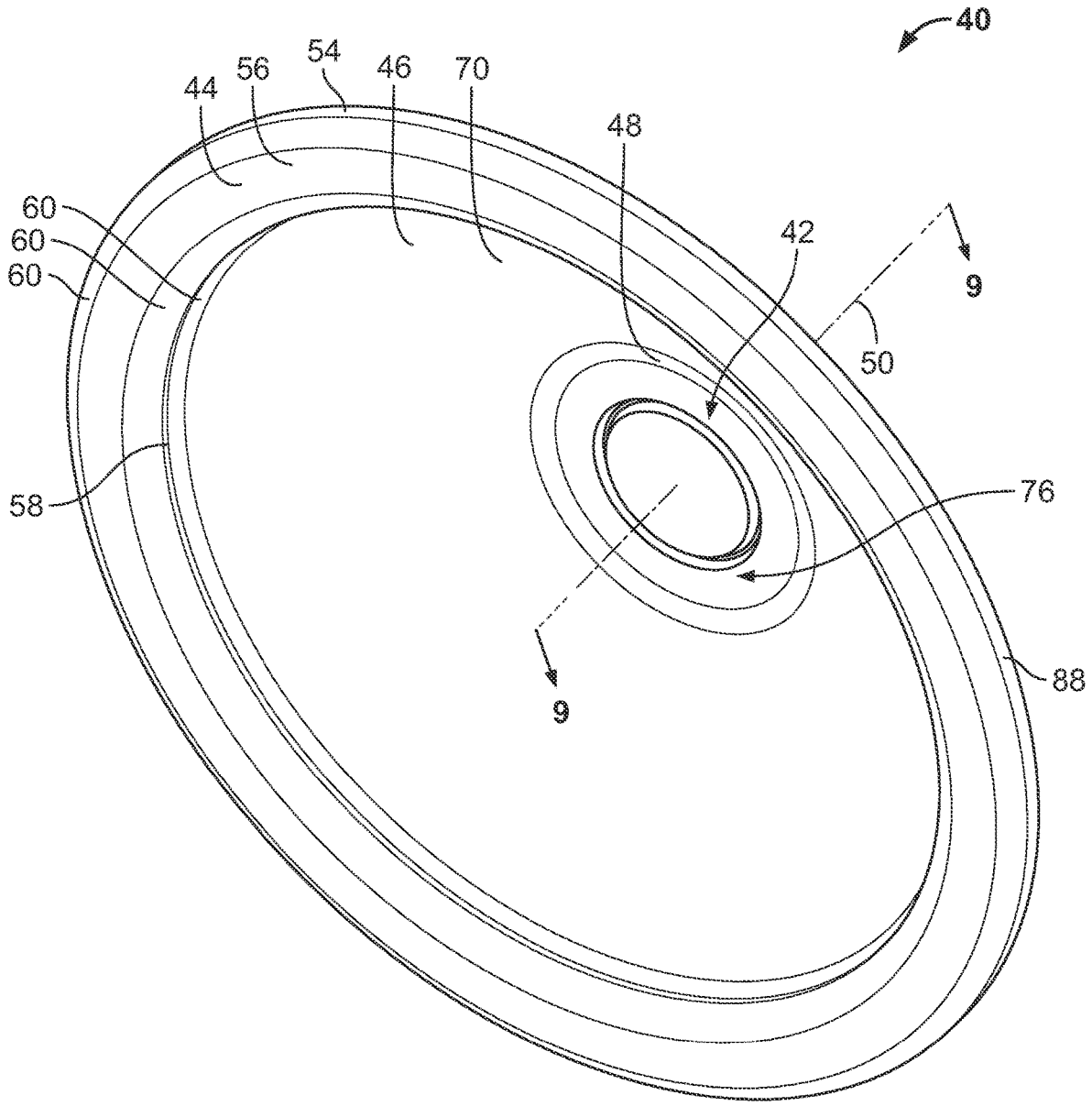
FIG. 7 is a bottom isometric view of a lid or base for a container, the lid or base having a fourth embodiment of a pressure relief feature.
Figure 9:
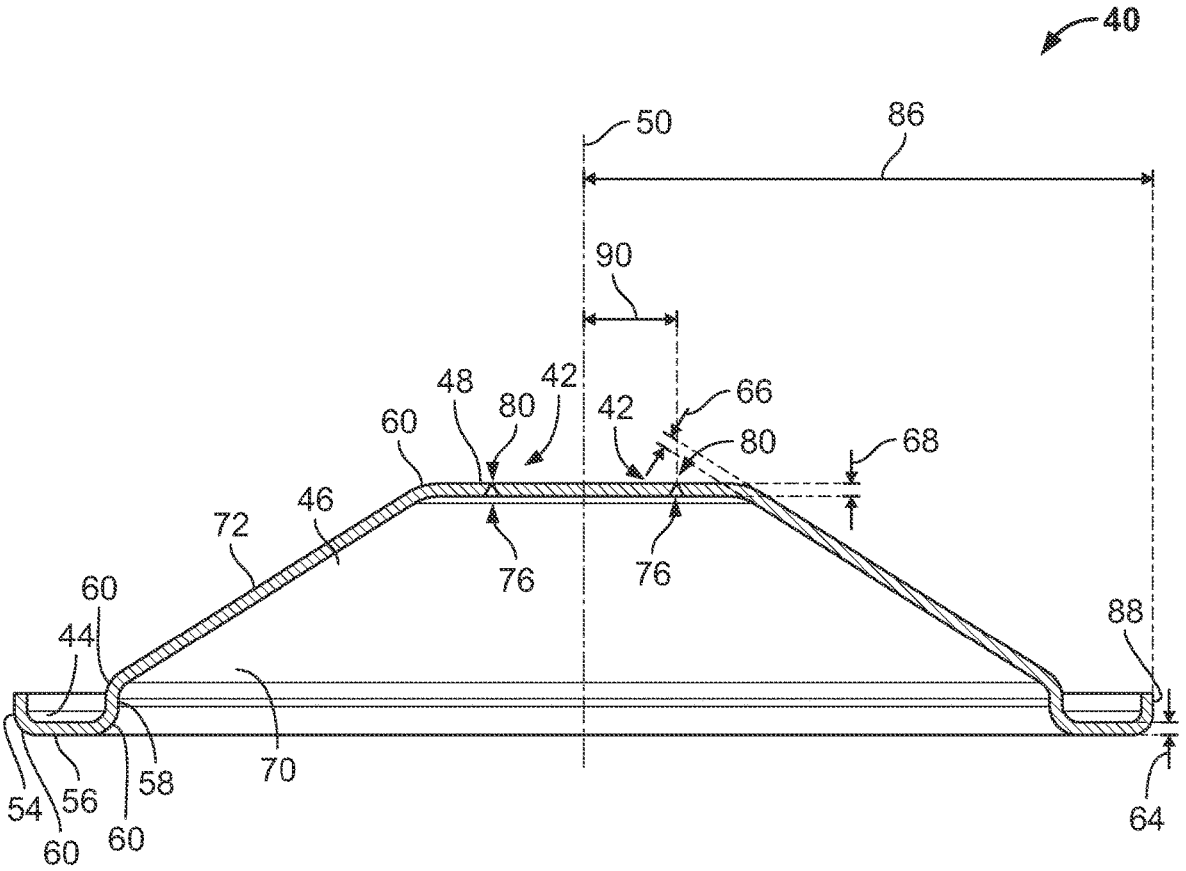
FIG. 9 is a cross-sectional, side view of the lid or base taken through line 9-9 of FIG. 7.

Referring now to FIGS. 7 and 9, the lid or base 40 and the pressure relief feature 42 are also radially symmetric about the longitudinal axis 50 since the pressure relief feature 42 extends entirely around the longitudinal axis 50. The longitudinal axis 50 is shown extending centrally through the lid or base 40, and the line segment or total radius 86 of the lid or base 40 is shown, being measured normal from the longitudinal axis 50 to the outermost surface 88 of the lid or base 40. Further, the venting radius 90 is shown, being measured normal from the longitudinal axis 50 to a location of the pressure relief feature 42. Since the pressure relief feature 42 defines a circle, the venting radius 90 is constant around the entire longitudinal axis 50. While the venting radius 90 is shown being less than about 18% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. In the present embodiment, the venting radius 90 is constant around the longitudinal axis 50 since the first venting feature 76 defines the shape of a circle.

Figure 8:
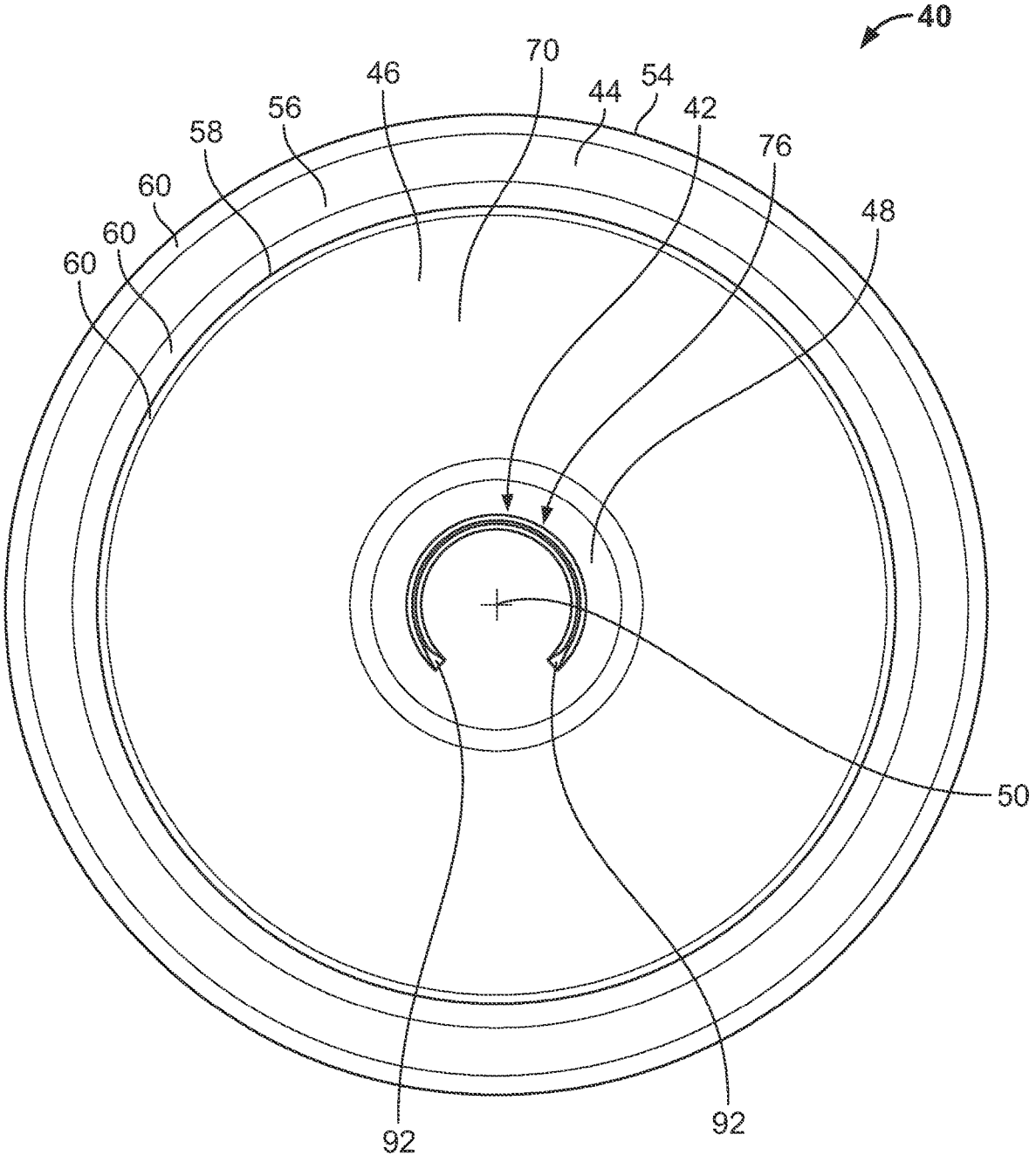
FIG. 8 is a bottom plan view of a lid or base for a container similar to the lid or base for a container of FIG. 7.

Referring to FIG. 8, the lid or base 40 and the pressure relief feature 42 are similar to the lid or base 40 and pressure relief feature 42 of FIGS. 7 and 9 but differ in that the pressure relief feature 42 does not extend entirely around the central longitudinal axis 50. As noted above, the pressure relief feature 42 of FIG. 8 is disposed about 275° around the longitudinal axis. In some embodiments, the pressure relief feature 42 may be disposed between about 150° and about 350°, or about 200 and about 325°, or about 250° and about 300°, or about 260° and about 290° about the central longitudinal axis 50. Still referring to FIG. 8, venting ramps 92 are disposed at the beginning and end points of the pressure relief feature 42, which are shown in the form of gradual tapered portions at distal ends of the pressure relief feature 42. The venting ramps 92 are generally trapezoidal in shape when viewed from below, but the venting ramps 92 may define other shapes such as triangles, squares, rectangles, or another polygonal shape. The venting ramps 92 may be formed through a manufacturing process, and may define various different taper angles depending upon the notch depth and configuration of the pressure relief feature 42.

Figure 10:
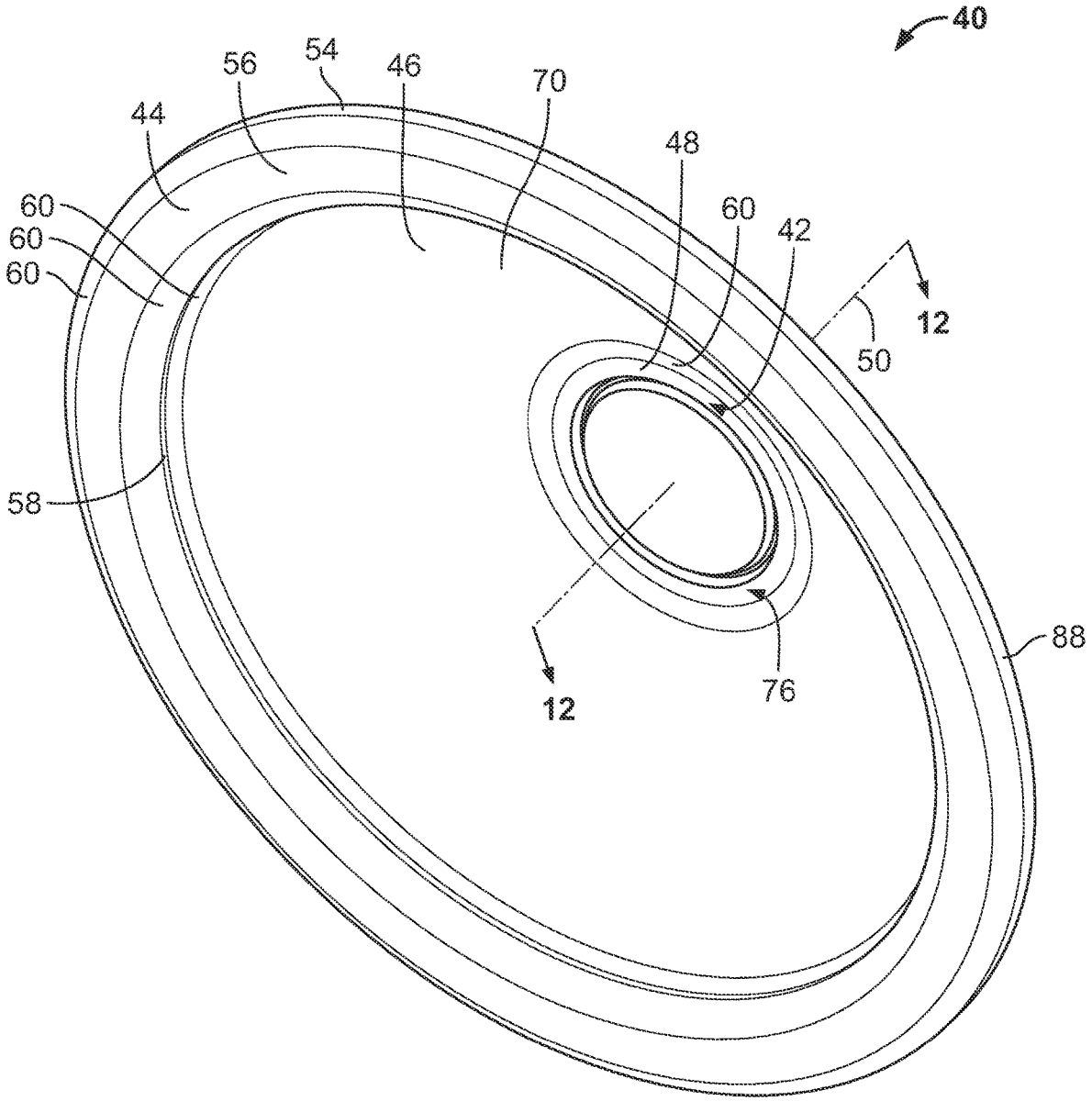
FIG. 10 is a bottom isometric view of a lid or base for a container, the lid or base having a fifth embodiment of a pressure relief feature.
Figure 12:
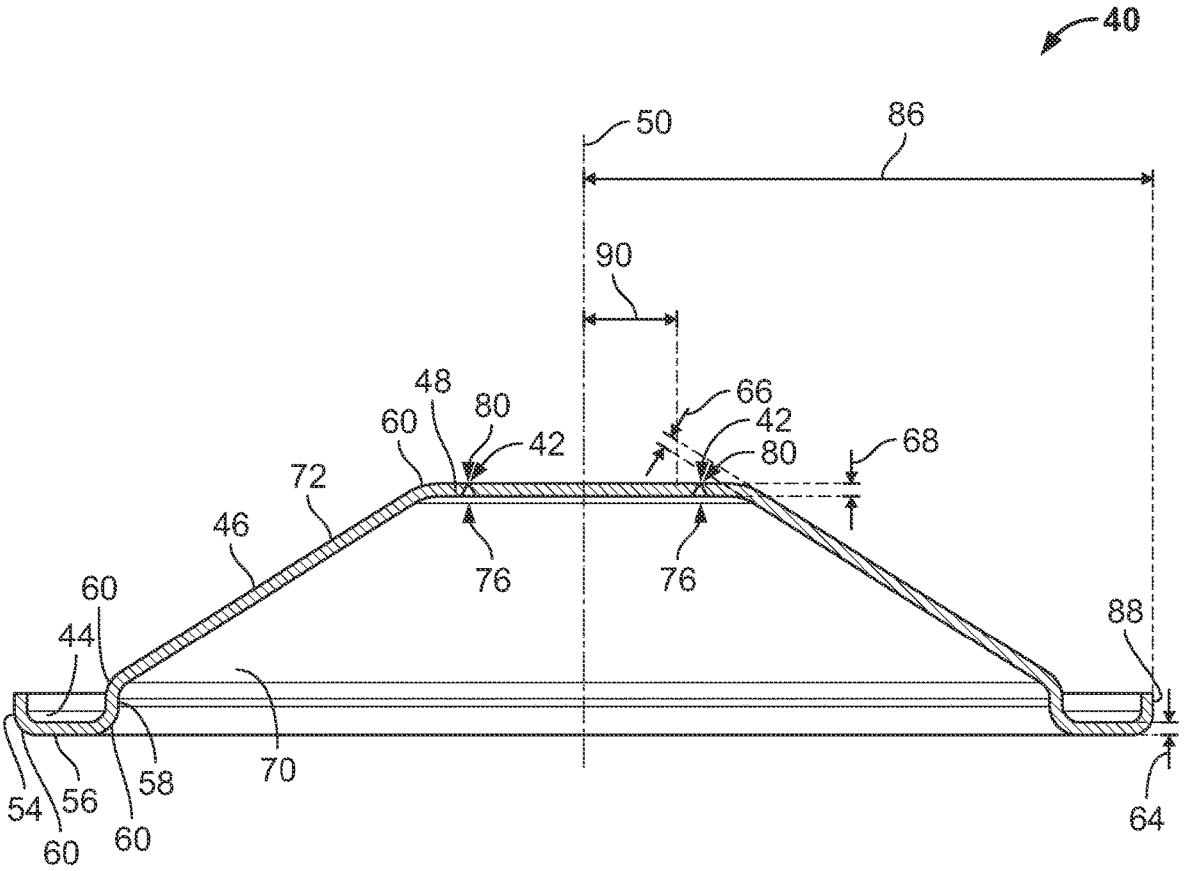
FIG. 12 is a cross-sectional, side view of the lid or base taken through line 12-12 of FIG. 10.

Referring now to FIGS. 10 and 12, the lid or base 40 and the pressure relief feature 42 are radially symmetric about the central longitudinal axis 50 since the pressure relief feature 42 extends entirely around the longitudinal axis 50. The longitudinal axis 50 is shown extending centrally through the lid or base 40, and the line segment or total radius 86 of the lid or base 40 is shown, being measured normal from the longitudinal axis 50 to the outermost surface 88 of the lid or base 40. Further, the venting radius 90 is shown, being measured normal from the longitudinal axis 50 to an outermost location of the pressure relief feature 42. Since the pressure relief feature 42 defines a circle, the venting radius 90 is constant around the entire central longitudinal axis 50. While the venting radius 90 is shown being less than about 22% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. In the present embodiment, the venting radius 90 is constant around the central longitudinal axis 50 since the first venting feature 76 defines the shape of a circle.

Figure 11:
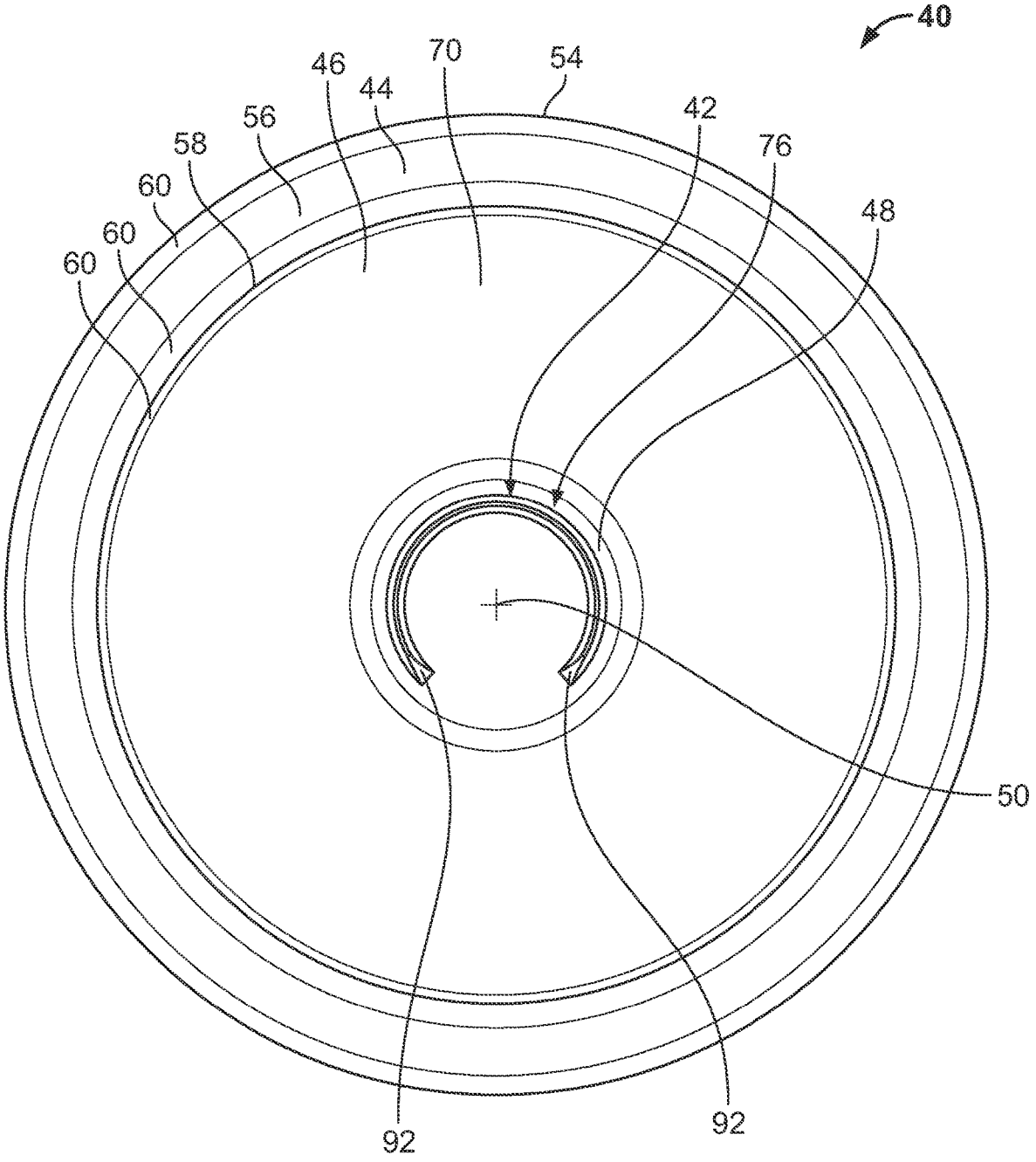
FIG. 11 is a bottom plan view of a lid or base for a container similar to the lid or base for a container of FIG. 9.

Referring to FIG. 11, the lid or base 40 and the pressure relief feature 42 are similar to the lid or base 40 and pressure relief feature 42 of FIGS. 10 and 12 but differ in that the pressure relief feature 42 does not extend entirely around the central longitudinal axis 50. As noted above, the pressure relief feature 42 of FIG. 11 is disposed about 275° around the longitudinal axis. In some embodiments, the pressure relief feature 42 may be disposed between about 150° and about 350°, or about 200 and about 325°, or about 250° and about 300°, or about 260° and about 290° about the central longitudinal axis 50. Still referring to FIG. 11, the venting ramps 92 are disposed at the beginning and end points of the pressure relief feature 42, which are shown in the form of gradual tapered portions at distal ends of the pressure relief feature 42. The venting ramps 92 are generally trapezoidal in shape when viewed from below, but the venting ramps 92 may define other shapes such as triangles, squares, rectangles, or another polygonal shape. The venting ramps 92 may be formed through a manufacturing process and may define various different taper angles depending upon the notch depth and configuration of the pressure relief feature 42.

Figure 13:
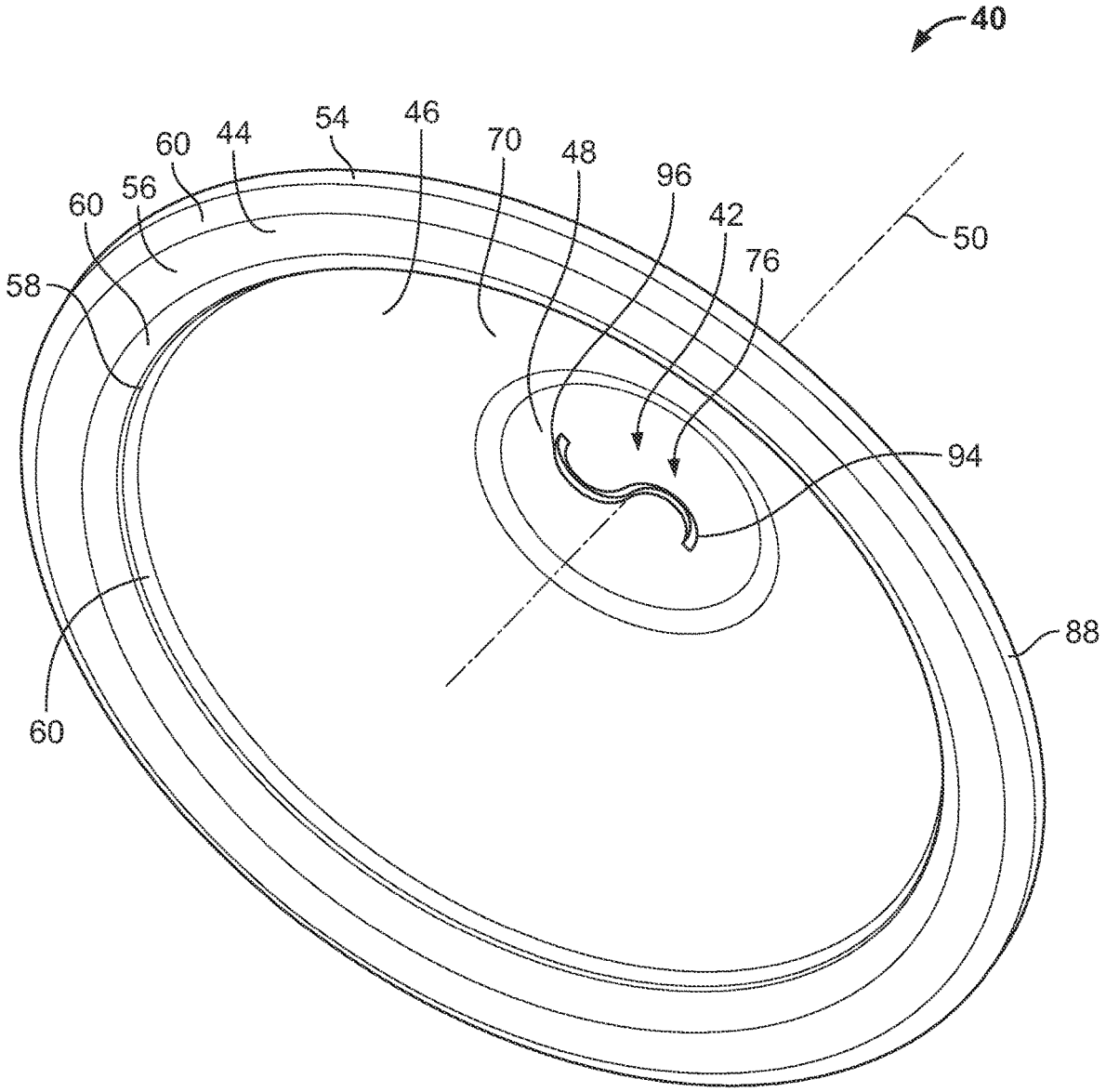
FIG. 13 is a bottom isometric view of a lid or base for a container, the lid or base having a sixth embodiment of a pressure relief feature.
Figure 14:
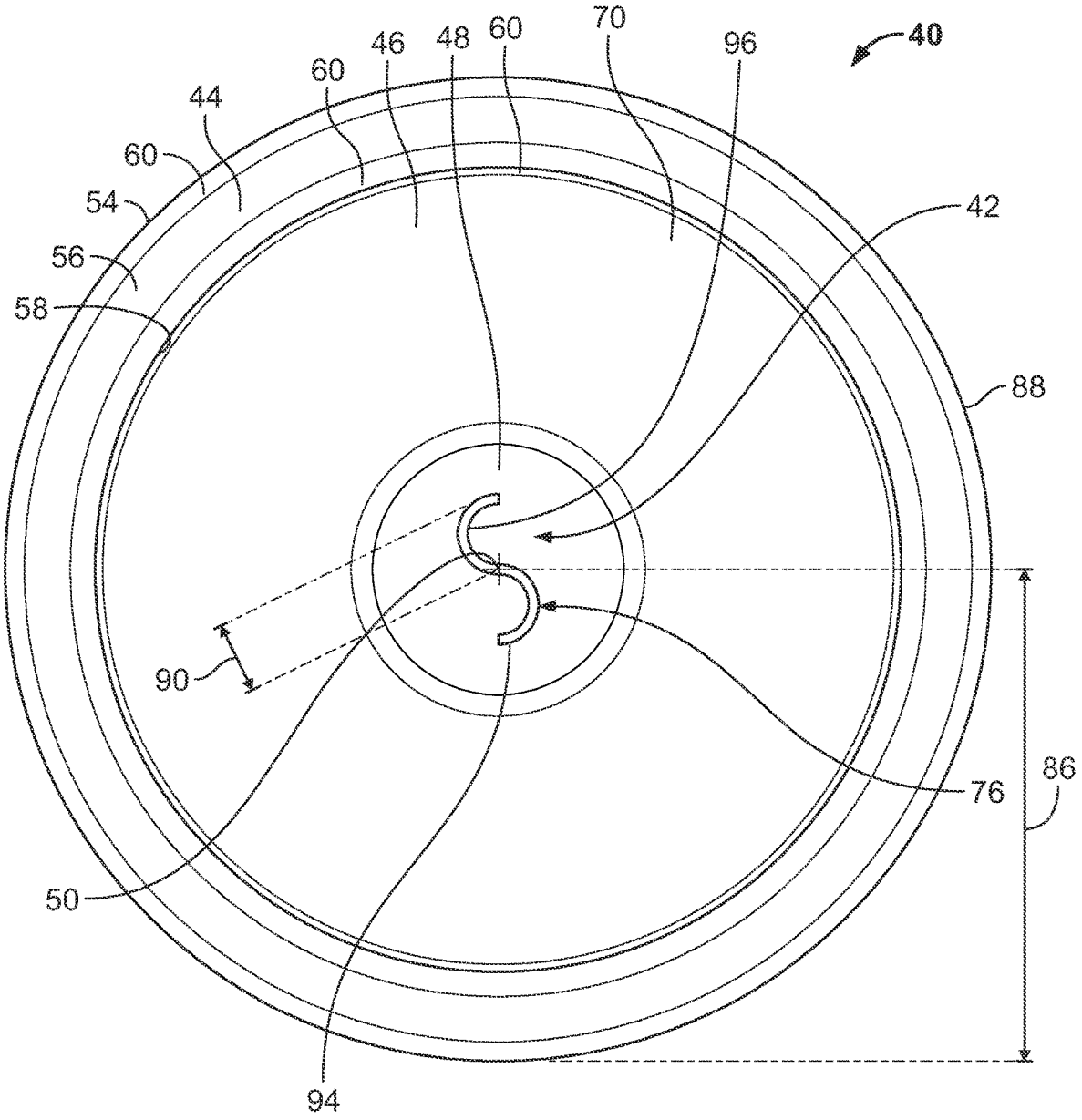
FIG. 14 is a bottom plan view of the lid or base for a container of FIG. 13.

Referring to FIGS. 13 and 14, another embodiment of the pressure relief feature 42 is shown. The pressure relief feature 42 includes the first venting feature 76. The first venting feature 76 of the present embodiment is an s-shaped venting feature and includes a first or lower portion 94 and a second or upper portion 96 that intersect at an inflection point. The first portion 94 and the second portion 96 define lower and upper lobes of the s-shape, i.e., a spline-shaped and continuous segment. In the present embodiment, the central longitudinal axis 50 extends through the inflection point between the first portion 94 and the second portion 96. However, in other embodiments, the inflection point of the first venting feature 76 may be offset from the central longitudinal axis 50. In some embodiments, the first portion 94 and the second portion 96 may be of different sizes, may define different radii of curvature, or may extend varying distances around the longitudinal axis 50. Referring to FIG. 14, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. In the present embodiment, the venting radius 90 extends through points along first venting feature 76 that are farthest from the central longitudinal axis 50, which are spaced from distal ends of the first venting feature 76.

Figure 15:
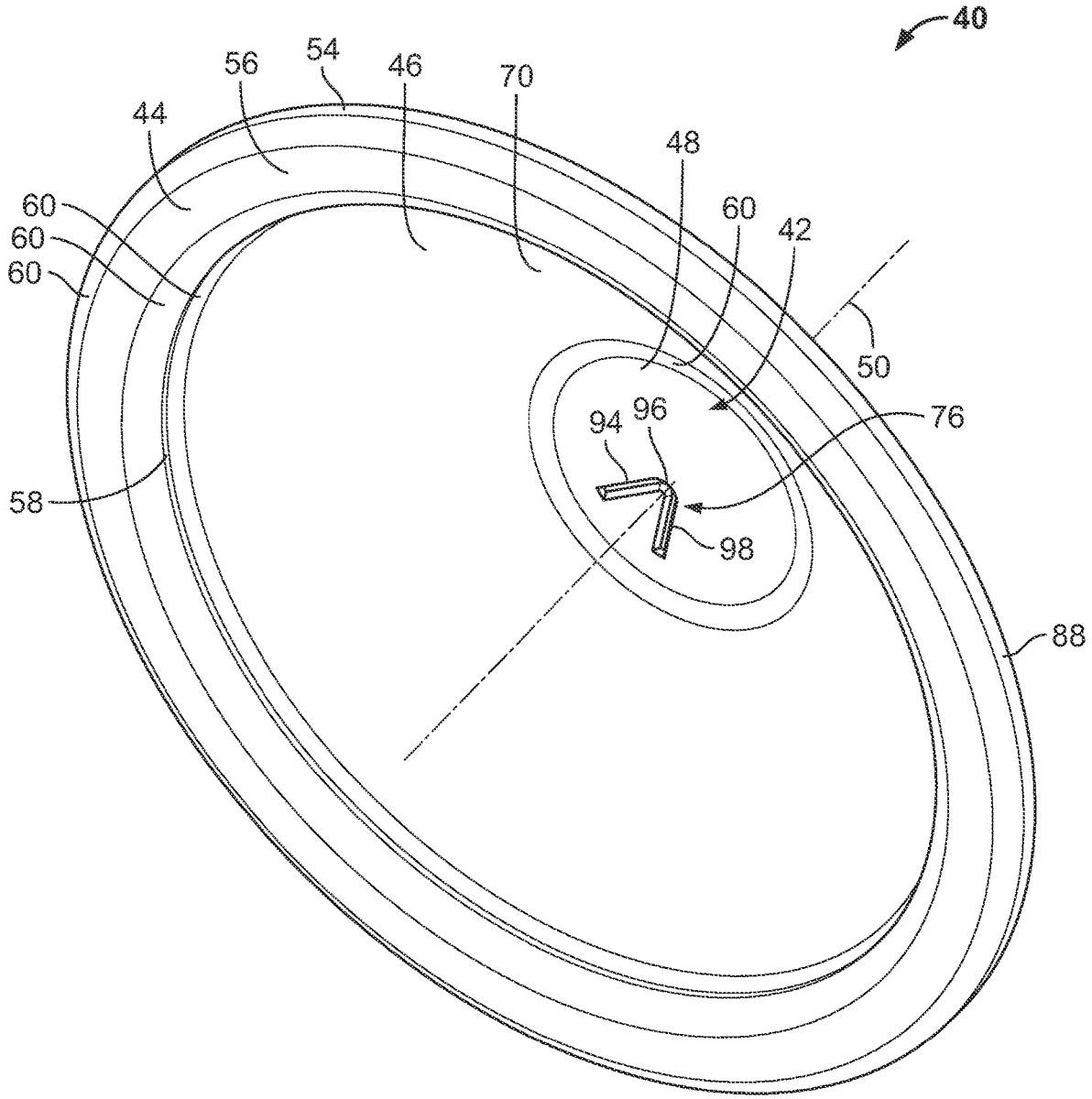
FIG. 15 is a bottom isometric view of a lid or base for a container, the lid or base having a seventh embodiment of a pressure relief feature.
Figure 16:
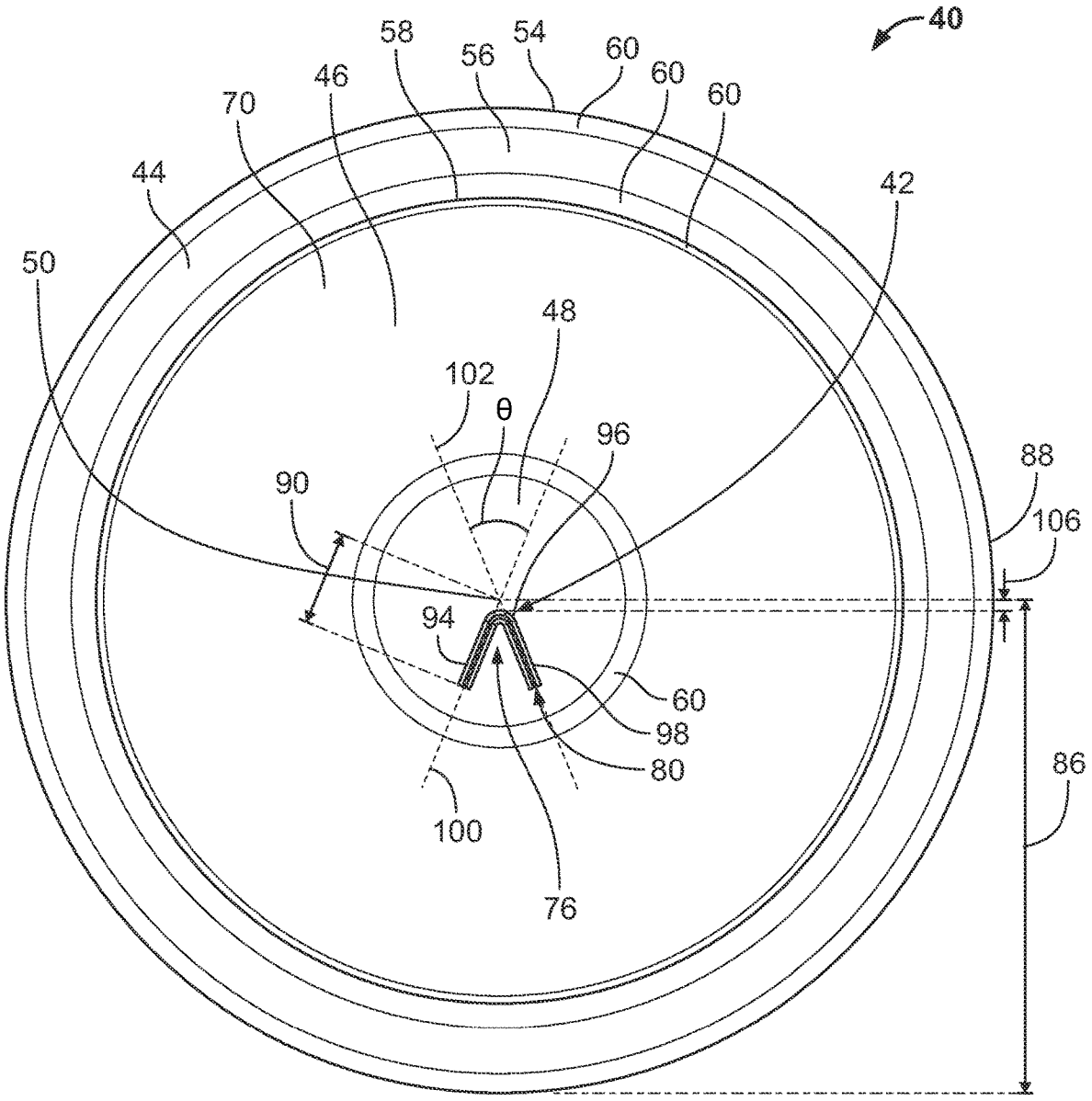
FIG. 16 is a bottom plan view of the lid or base of FIG. 15.

Referring now to FIGS. 15 and 16, another embodiment of the pressure relief feature 42 is shown. The pressure relief feature 42 includes the first venting feature 76. The first venting feature 76 of the present embodiment is a v-shaped venting feature, and includes a first or left portion 94, a second or intermediate portion 96, and a third or right portion 98. The left portion 94 is a mirror image of the right portion 98 of the v-shaped venting feature, and the left portion 94 is connected with the right portion 98 via the intermediate portion 96. A first plane or line 100 extends through the left portion 94 and the longitudinal axis 50, and a second plane or line 102 extends through the right portion 98 and the longitudinal axis 50. The first plane 100 and the second plane 102 intersect at the longitudinal axis 50. In the present embodiment, the first plane 100 extends along an entire length of the first portion 94, and the second plane 102 extends along an entire length of the third portion 98. In some embodiments, a third venting feature 104 (see FIG. 21) may also be provided on either side of the first and second venting features 76, 78.

Still referring to FIGS. 15 and 16, the longitudinal axis 50 is shown extending centrally through the lid or base 40, and the line segment or total radius 86 of the lid or base 40 is shown, being measured normal from the longitudinal axis 50 to the outermost surface 88 of the lid or base 40. Further, the venting radius 90 is shown, being measured normal from the longitudinal axis 50 to an outermost location of the pressure relief feature 42 taken along the first line 100 or the second line 102. In the present embodiment, the venting radius 90 extends to a radially outermost location of the first venting feature 76. Thus, the venting radius 90 in the present embodiment extends to a farthest extent of the first portion 94 or the third portion 98. While the venting radius 90 is shown being less than about 22% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50.

Still further, a minimum venting distance 106 is shown in FIG. 16, which defines the closest distance between the longitudinal axis 50 and the pressure relief feature 42. The minimum venting distance 106 may be less than about 50% of the venting radius 90, less than about 40% of the venting radius 90, less than about 30% of the venting radius 90, less than about 20% of the venting radius 90, or less than about 15% of the venting radius 90, or less than about 10% of the venting radius 90, or less than about 7% of the venting radius 90, or less than about 5% of the venting radius 90. Still further, the minimum venting distance 106 may be less than about 10% of the total radius 86, or less than about 8% of the total radius 86, or less than about 6% of the total radius 86, or less than about 4% of the total radius 86, or less than about 2% of the total radius 86. The minimum venting distance 106 may also be greater than about 1% of the venting radius 90, or greater than about 1% of the total radius 86.

Figure 17:
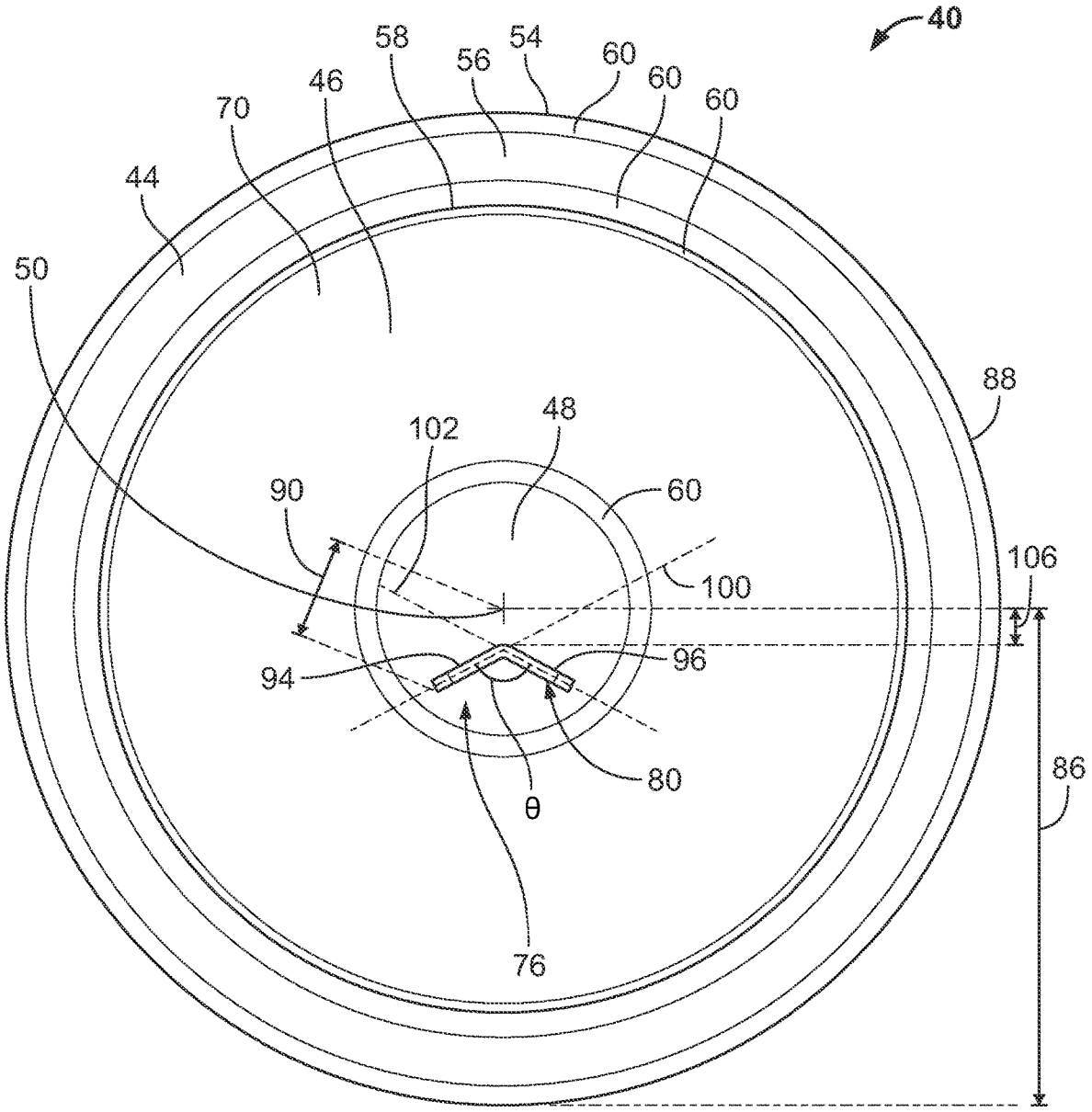
FIG. 17 is a bottom plan view of a lid or base for a container similar to the lid or base for a container of FIGS. 15 and 16.

Referring to FIG. 17, a pressure relief feature 42 is depicted that is similar to the pressure relief feature 42 of FIGS. 15 and 16, but defines a larger minimum venting distance 106, and a larger angle ⊖ between the first line 100 and the second line 102. The angle ⊖ of FIG. 17 is about 122°, and the angle ⊖ of FIG. 16 is about 46°. In some embodiments, the angle ⊖ may be between about 20° and about 160°, or between about 30° and 150°, or between about 40° and about 140°, or between about 50° and 130°, or between about 60° and 120°. Further, the minimum venting distance 106 of FIG. 17 is about 70% of the venting radius 90, while the minimum venting distance 106 of FIG. 16 is about 20% of the venting radius 90. In some embodiments, the minimum venting distance is greater than about 10%, or about 20%, or about 30%, or about 40% or about 50%, or about 60%, or about 70% of the venting radius 90, expressed as a percentage. The first plane or line 100 extends through the first portion 94, and the second plane or line 102 extends through the right portion 98, but neither of the lines 100, 102 extend through the longitudinal axis 50.

Figure 18:
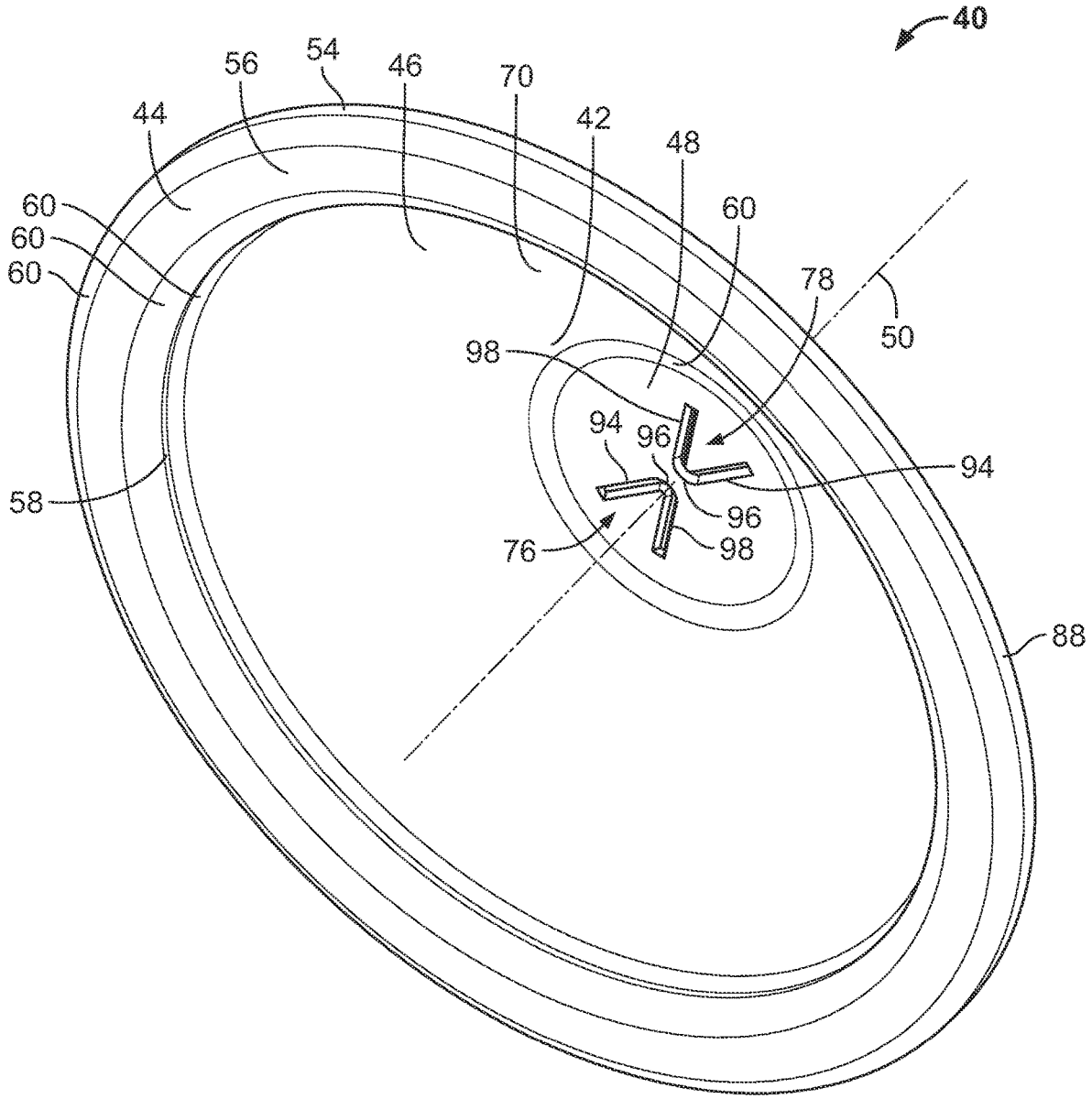
FIG. 18 is a bottom isometric view of a lid or base for a container, the lid or base having an eighth embodiment of a pressure relief feature.
Figure 19:
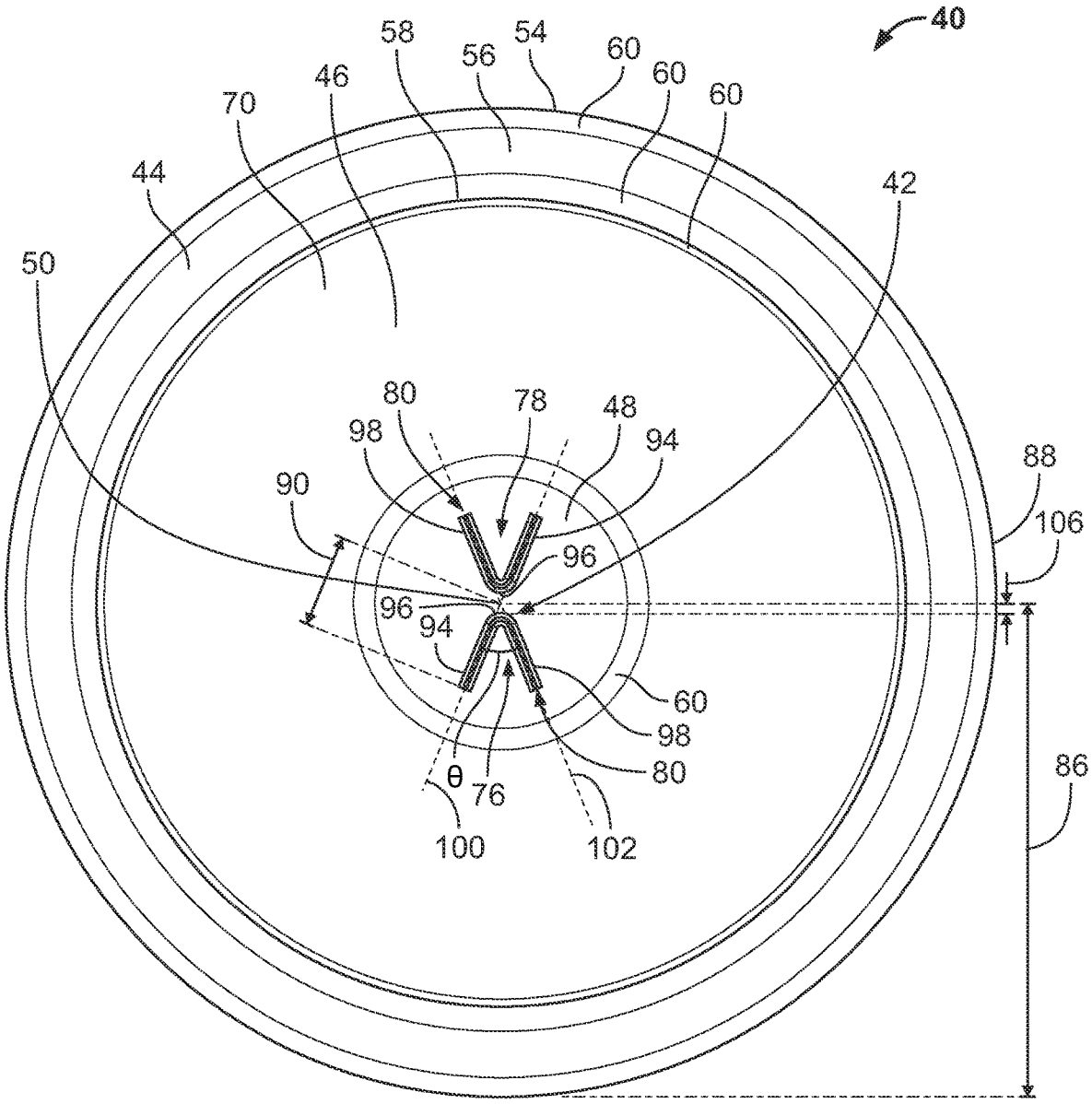
FIG. 19 is a bottom plan view of the lid or base of FIG. 18.

Referring now to FIGS. 18 and 19, another embodiment of the pressure relief feature 42 is shown. The pressure relief feature 42 includes the first venting feature 76 and a second venting feature 78 that is a mirror image of the first venting feature 76. Both the first and second venting features 76, 78 include the first or left portion 94, the second or intermediate portion, and the third or right portion 98. The left portion 94 is a mirror image of the right portion 98 of the first and second venting features 76, 78, and the left portion 94 is connected with the right portion 98 via the intermediate portion 96. The first plane or line 100 extends through both of the left portions 94 and the longitudinal axis 50, and the second plane or line 102 extends through both of the right portions 98 and the longitudinal axis 50. The first plane 100 and the second plane 102 intersect at the longitudinal axis 50. In the present embodiment, the first plane 100 extends along an entire length of the first portions 94, and the second plane 102 extends along an entire length of the third portions 98. The first plane 100 also extends through the first venting feature 76 and the second venting feature 78, and the second plane 102 extends through the first venting feature 76 and the second venting feature 78.

Still referring to FIGS. 18 and 19, the longitudinal axis 50 is shown extending centrally through the lid or base 40, and the line segment or total radius 86 of the lid or base 40 is shown, being measured normal from the longitudinal axis 50 to the outermost surface 88 of the lid or base 40. Further, the venting radius 90 is shown, being measured normal from the longitudinal axis 50 to an outermost location of the pressure relief feature 42. In the present embodiment, the venting radius 90 extends to a radially outermost location of the first venting feature 76. Thus, the venting radius 90 in the present embodiment extends to a farthest extent of the first portion 94 or the third portion 98 of the venting features 76, 78. While the venting radius 90 is shown being less than about 22% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50.

Still further, the minimum venting distance 106 is shown in FIG. 19, which defines the closest distance between the longitudinal axis 50 and the pressure relief feature 42. The minimum venting distance 106 may be less than about 20% of the venting radius 90, or less than about 15% of the venting radius 90, or less than about 10% of the venting radius 90, or less than about 7% of the venting radius 90, or less than about 5% of the venting radius 90. Still further, the minimum venting distance 106 may be less than about 10% of the total radius 86, or less than about 8% of the total radius 86, or less than about 6% of the total radius 86, or less than about 4% of the total radius 86, or less than about 2% of the total radius 86. The minimum venting distance 106 may also be greater than about 1% of the venting radius 90, or greater than about 1% of the total radius 86.

Figure 20:
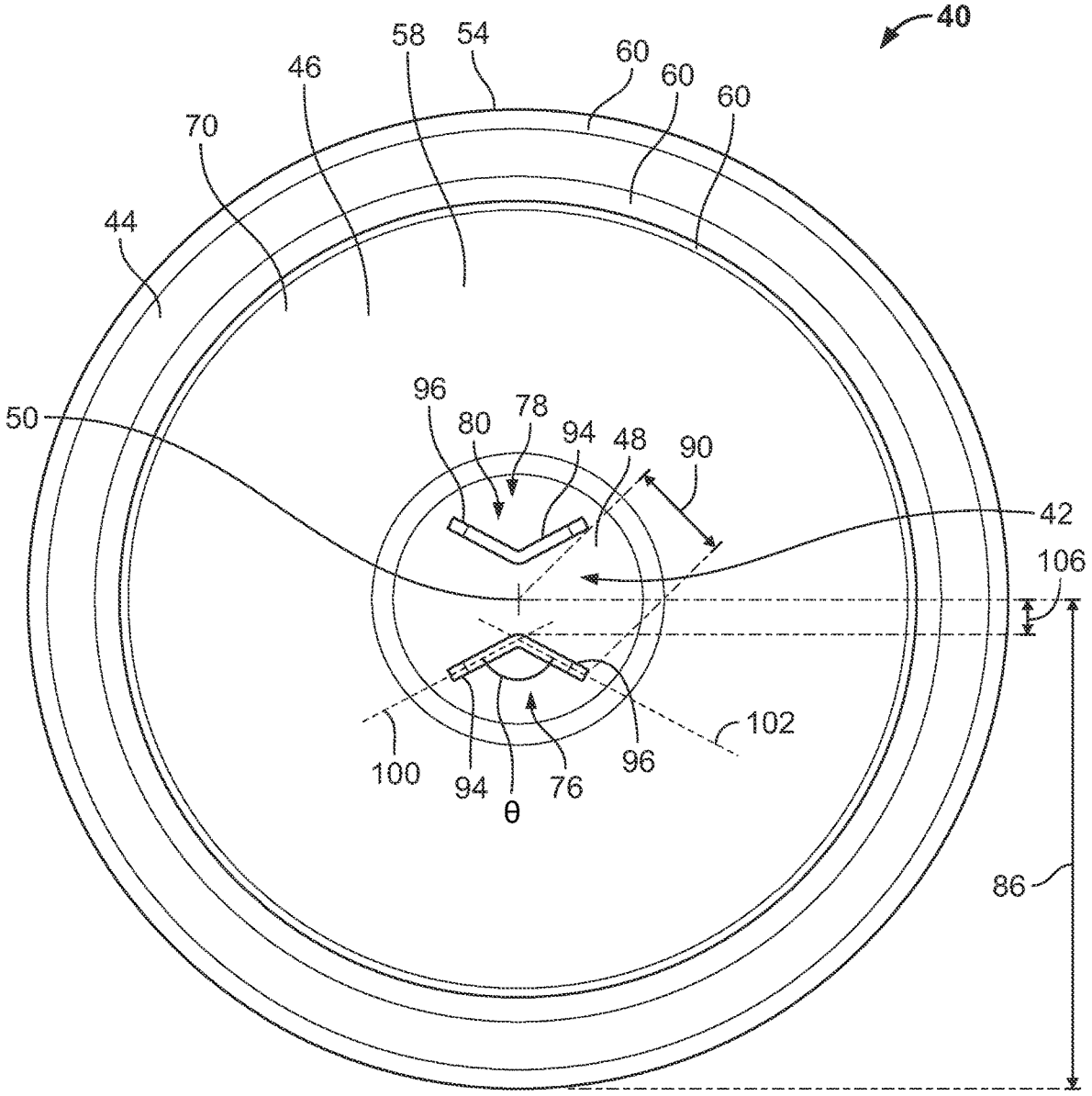
FIG. 20 is a bottom plan view of a lid or base for a container similar to the lid or base for a container of FIGS. 18 and 19.

Referring to FIG. 20, a pressure relief feature 42 is depicted that is similar to the pressure relief feature 42 of FIGS. 18 and 19, but defines a larger minimum venting distance 106, and a larger angle ⊖ between the first line 100 and the second line 102. The angle ⊖ of FIG. 20 is about 122°, and the angle ⊖ of FIG. 19 is about 46°. In some embodiments, the angle ⊖ may be between about 20° and about 160°, or between about 30° and 150°, or between about 40° and about 140°, or between about 50° and 130°, or between about 60° and 120°. Further, the minimum venting distance 106 of FIG. 17 is about 70% of the venting radius 90, while the minimum venting distance 106 of FIG. 16 is about 20% of the venting radius 90. In some embodiments, the minimum venting distance is greater than about 10%, or about 20%, or about 30%, or about 40% or about 50%, or about 60%, or about 70% of the venting radius 90, expressed as a percentage. The first plane or line 100 extends through the first portion 94, and the second plane or line 102 extends through the right portion 98, but neither of the lines 100, 102 extend through the longitudinal axis 50. Further, neither of the lines 100, 102 extend through both the first venting feature 76 and the second venting feature 78.

Figure 21:
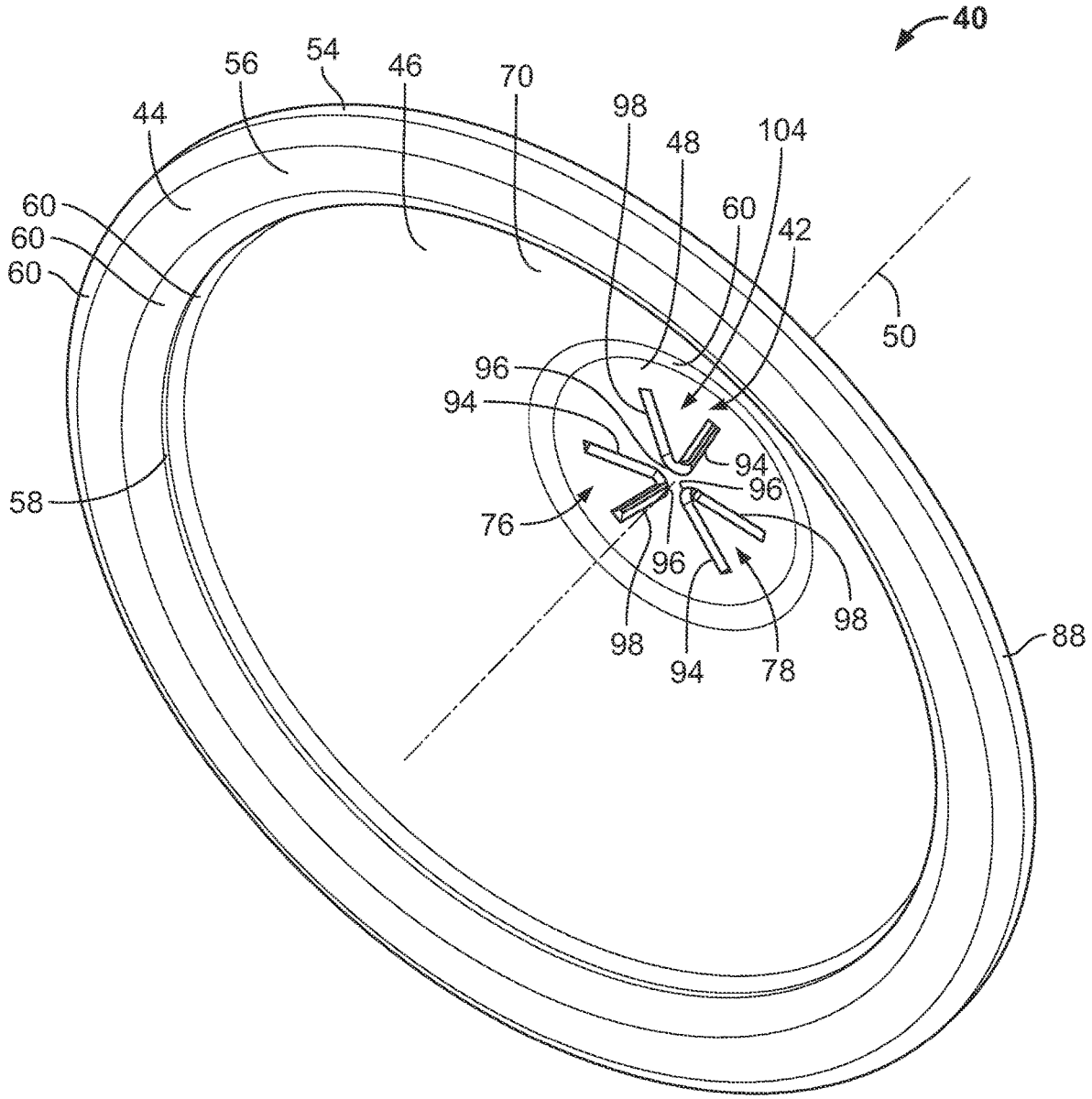
FIG. 21 is a bottom isometric view of a lid or base for a container, the lid or base having a ninth embodiment of a pressure relief feature.
Figure 22:
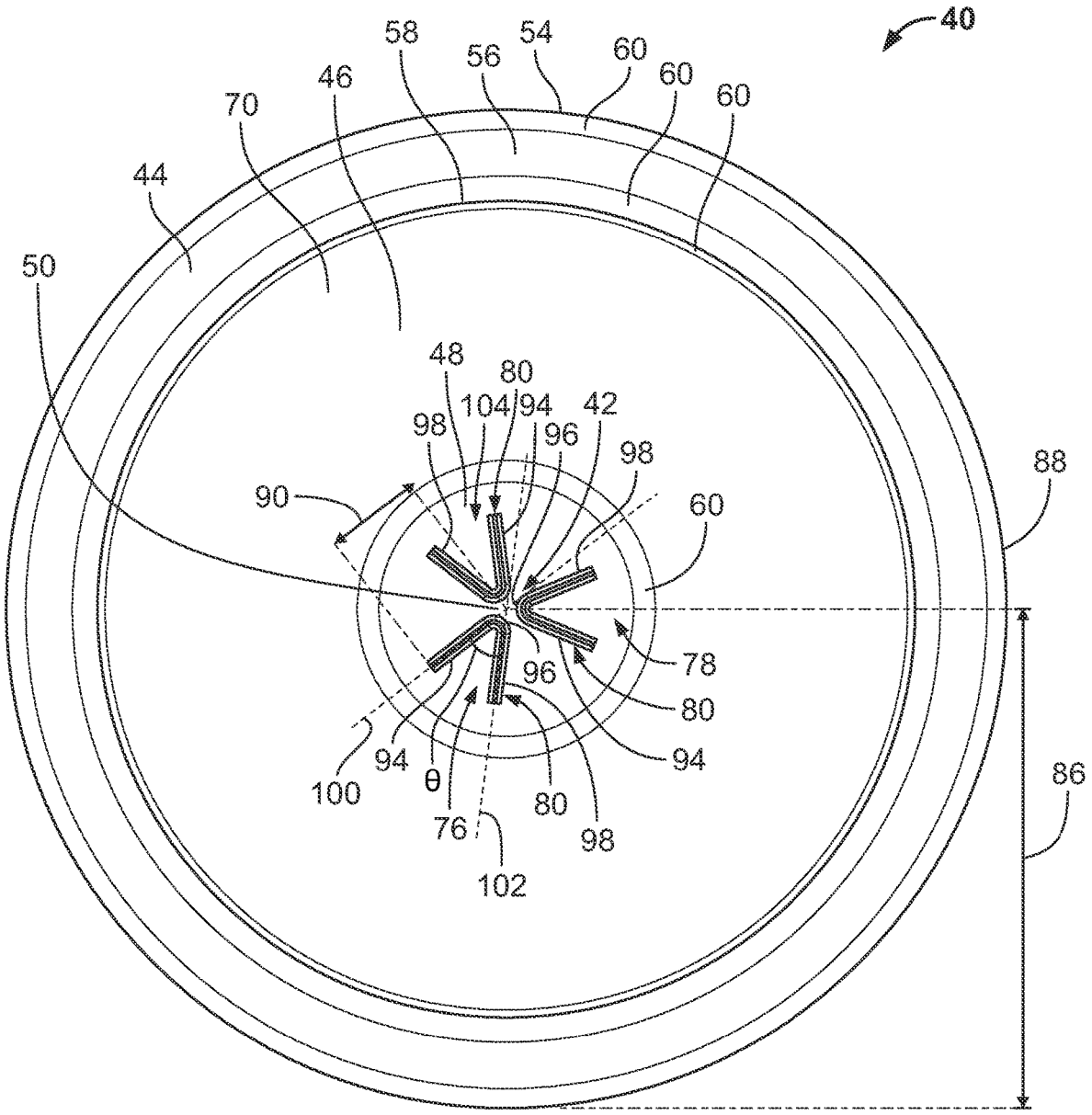
FIG. 22 is a bottom plan view of the lid or base of FIG. 21.

Referring now to FIGS. 21 and 22, another embodiment of the pressure relief feature 42 is shown. The pressure relief feature 42 includes the first venting feature 76, the second venting feature 78, and the third venting feature 104. The venting features 76, 78, 104 include the first or left portion 94, the second or intermediate portion 96, and the third or right portion 98. The left portions 94 are each a mirror image of the right portions 98 of the venting features 76, 78, 104, and the left portions 94 are connected with the right portions 98 via the intermediate portion 96. The first plane or line 100 extends through the left portion 94 of the first venting feature 76 and the longitudinal axis 50, and the second plane or line 102 extends through the right portion 98 of the first venting feature 76 and the longitudinal axis 50. The first plane 100 and the second plane 102 intersect at the longitudinal axis 50. In the present embodiment, the first plane 100 extends along an entire length of the first portion 94, and the second plane 102 extends along an entire length of the third portion 98. Further, the first plane 100 and the second plane 102 only extend through the left portion 94 and the right portion 98 of the first venting feature 76, but do not extend through the respective portions of the second venting feature 78 or the third venting feature 104.

Still referring to FIGS. 21 and 22, the longitudinal axis 50 is shown extending centrally through the lid or base 40, and the line segment or total radius 86 of the lid or base 40 is shown, being measured normal from the longitudinal axis 50 to the outermost surface 88 of the lid or base 40. Further, the venting radius 90 is shown, being measured normal from the longitudinal axis 50 to a location of the pressure relief feature 42. In the present embodiment, the venting radius 90 extends to a radially outermost location of the first venting feature 76. Thus, the venting radius 90 in the present embodiment extends to a farthest extent of the first portion 94 or the third portion 98. While the venting radius 90 is shown being less than about 22% of the total radius 86 from the longitudinal axis 50, the venting radius 90 may be less than about 25% of the total radius 86 from the longitudinal axis 50, or less than about 20% of the total radius 86 from the longitudinal axis 50, or less than about 15% of the total radius 86 from the longitudinal axis 50, or less than about 10% of the total radius 86 from the longitudinal axis 50. The embodiment of FIGS. 21 and 22 may also include the minimum venting distance 106 as described above, which may have parameters that are similar to those described above with respect to FIGS. 15 and 16, and FIGS. 18 and 19.

Figure 23:
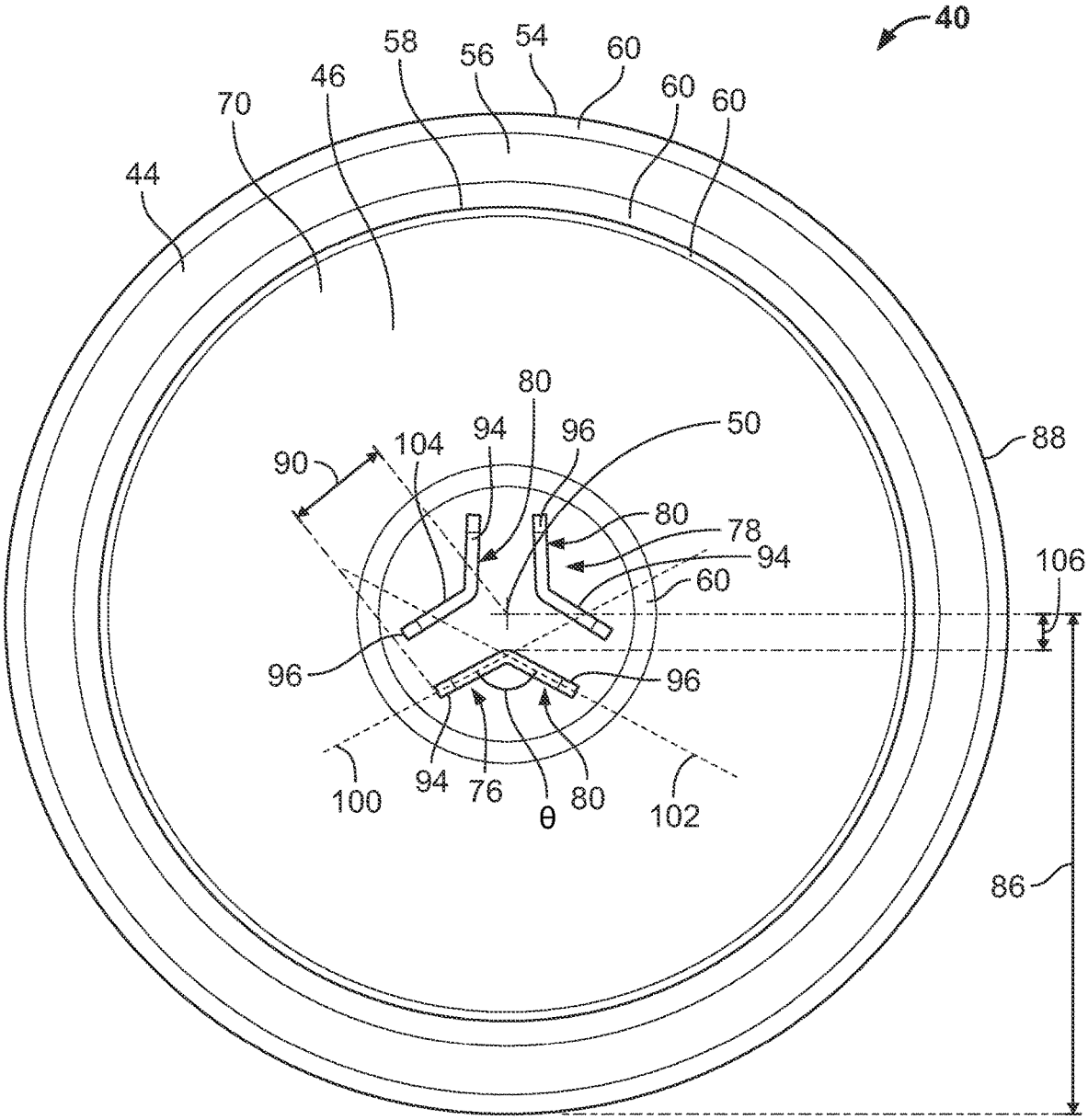
FIG. 23 is a bottom plan view of a lid or base for a container similar to the lid or base for a container of FIGS. 20 and 21.
Figure 24A:
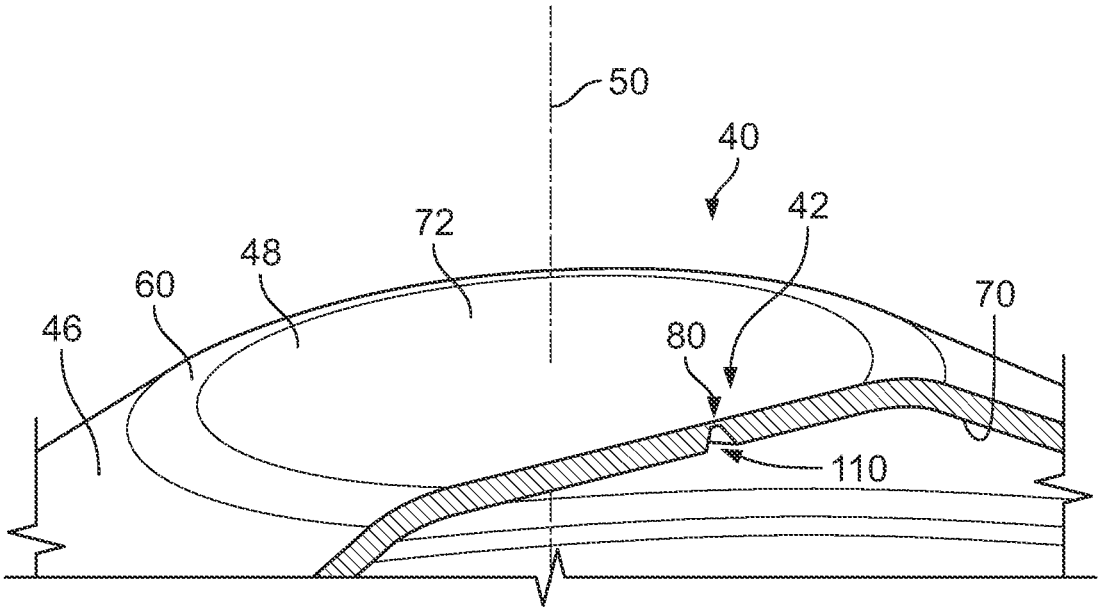
FIG. 24A is an isometric, cross-sectional view of a first profile of a pressure relief feature that may be applied to any of the lids or bases of FIGS. 1-23.
Figure 24B:
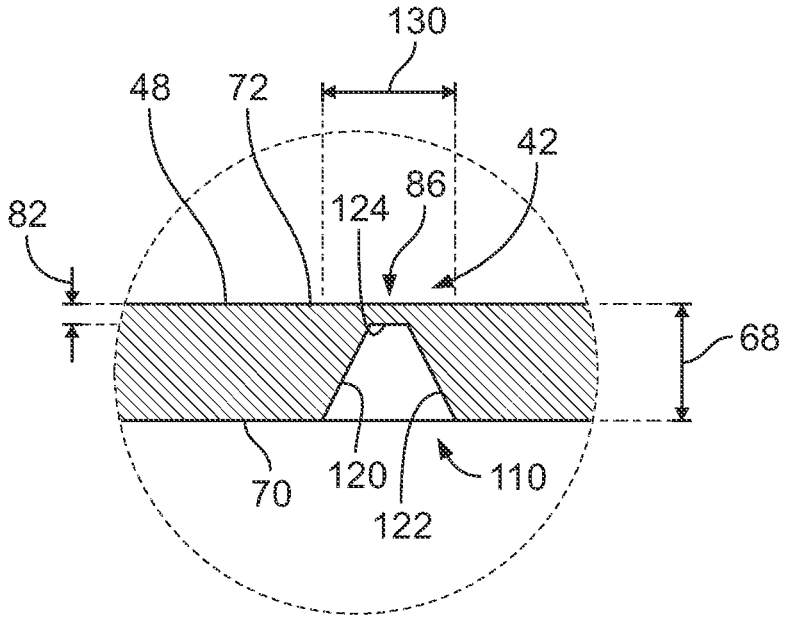
FIG. 24B is an enlarged side view of the first profile of the pressure relief feature of FIG. 24A.
Figure 25A:
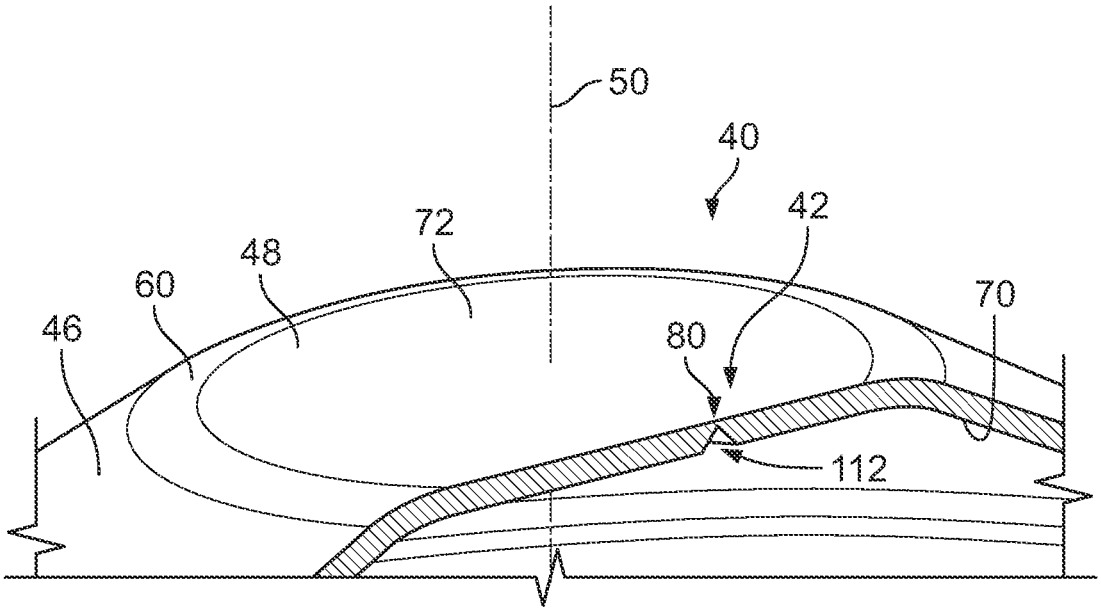
FIG. 25A is an isometric, cross-sectional view of a second profile of a pressure relief feature that may be applied to any of the lids or bases of FIGS. 1-23.
Figure 25B:
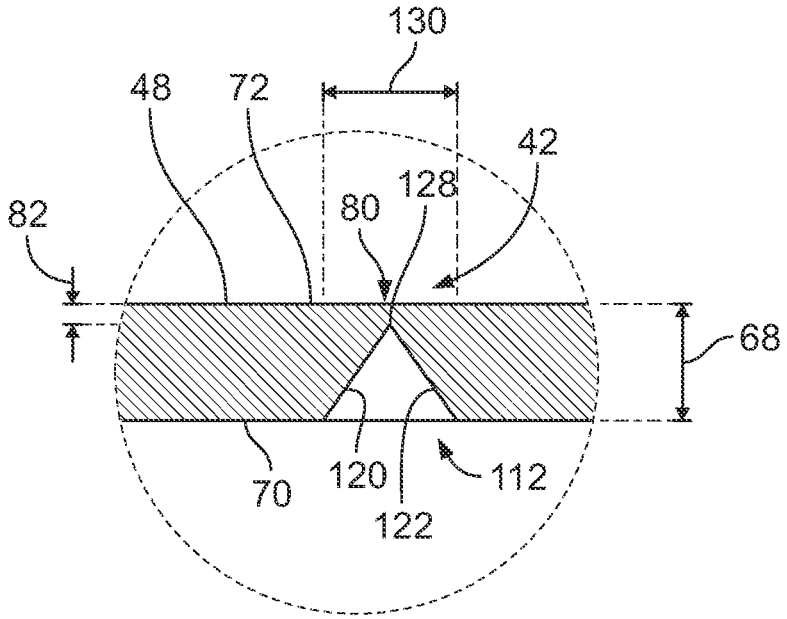
FIG. 25B is an enlarged side view of the second profile of the pressure relief feature of FIG. 25A.
Figure 26A:
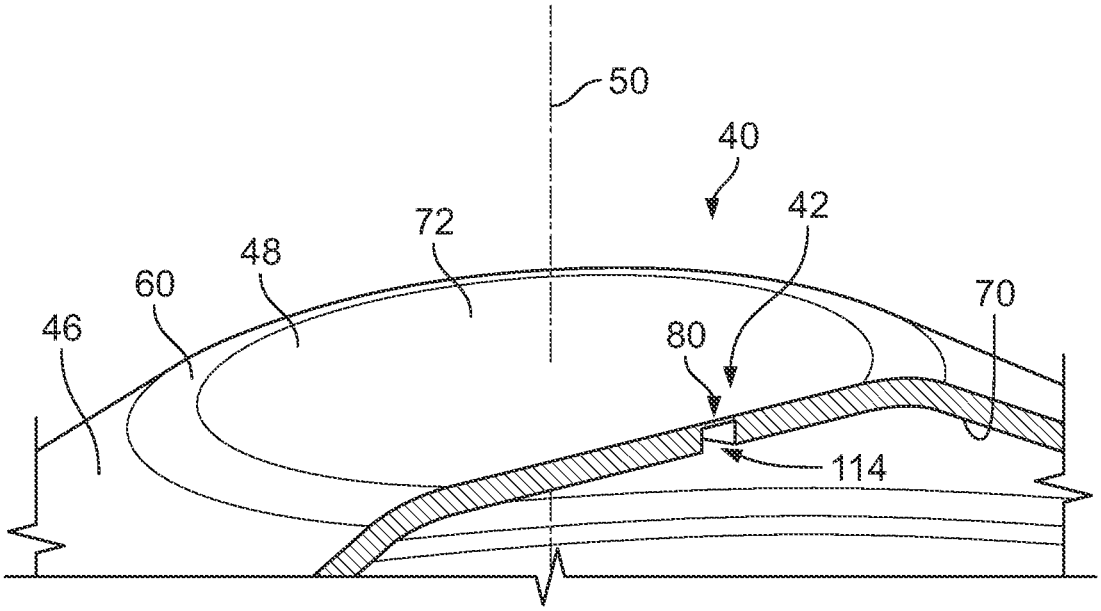
FIG. 26A is an isometric, cross-sectional view of a third profile of a pressure relief feature that may be applied to any of the lids or bases of FIGS. 1-23.
Figure 26B:
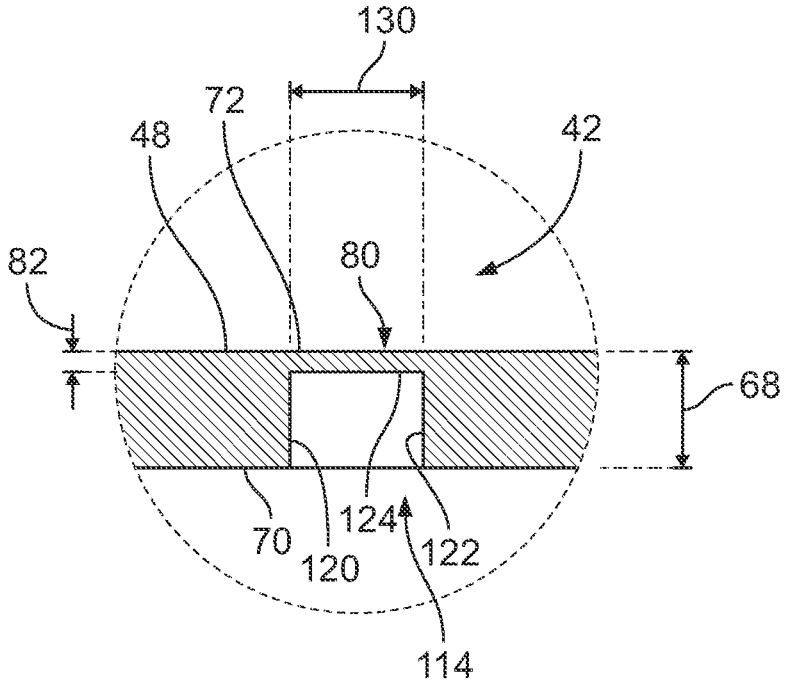
FIG. 26B is an enlarged side view of the third profile of the pressure relief feature of FIG. 26A.
Figure 27A:
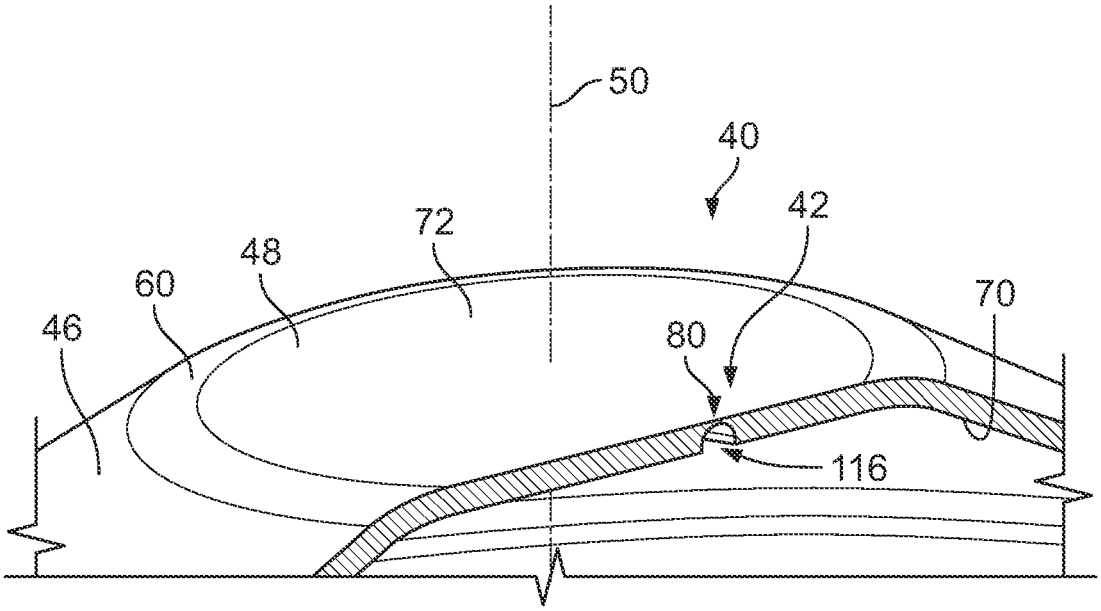
FIG. 27A is an isometric, cross-sectional view of a fourth profile of a pressure relief feature that may be applied to any of the lids or bases of FIGS. 1-23.
Figure 27B:
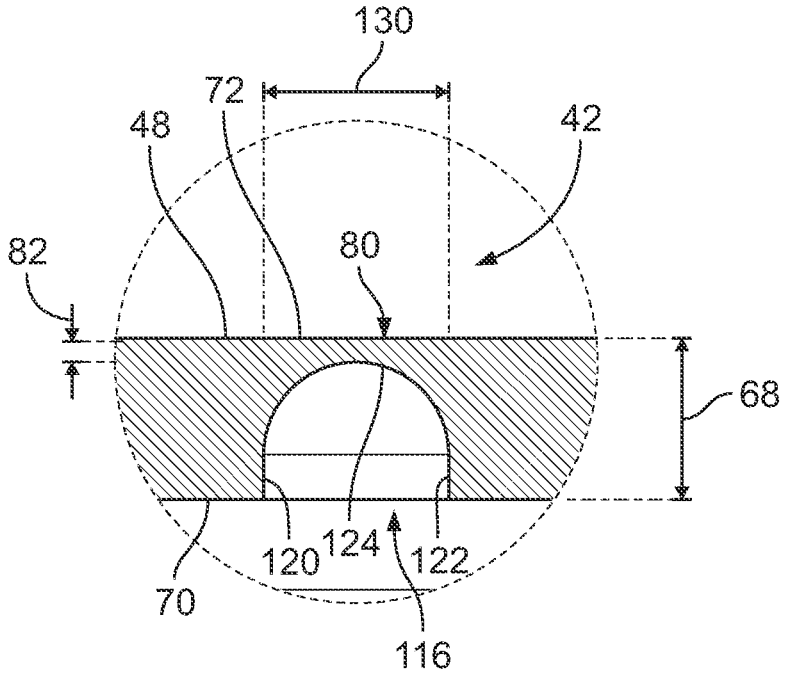
FIG. 27B is an enlarged side view of the fourth profile of the pressure relief feature of FIG. 27A.

Referring to FIG. 23, a pressure relief feature 42 is depicted that is similar to the pressure relief feature 42 of FIGS. 21 and 22, but defines a larger minimum venting distance 106, and a larger angle $\Theta$ between the first line 100 and the second line 102. The angle $\Theta$ of FIG. 20 is about 122°, and the angle $\Theta$ of FIG. 19 is about 46°. In some embodiments, the angle $\Theta$ may be between about 20° and about 160°, or between about 30° and 150°, or between about 40° and about 140°, or between about 50° and 130°, or between about 60° and 120°. Further, the minimum venting distance 106 of FIG. 17 is about 70% of the venting radius 90, while the minimum venting distance 106 of FIG. 16 is about 20% of the venting radius 90. In some embodiments, the minimum venting distance is greater than about 10%, or about 20%, or about 30%, or about 40% or about 50%, or about 60%, or about 70% of the venting radius 90, expressed as a percentage. The first plane or line 100 extends through the first portion 94, and the second plane or line 102 extends through the right portion 98, but neither of the lines 100, 102 extend through the longitudinal axis 50. Further, the first line 100 extends only through the first venting feature 76 and the second venting feature 78, while the second line 102 extends only through the first venting feature 76 and the third venting feature 104.

While the aforementioned embodiments of FIGS. 1-23 depict the pressure relief feature 42 disposed along the central wall 48 of the lid or base 40, it is contemplated that the pressure relief feature 42 may be provided along the intermediate wall 46 or the outer wall 44 in alternative embodiments. While the lid or base 40 is described and shown in the various figures as having bottom and top surfaces or sides 70, 72, it should be understood that the lid or base 40 may be disposed with either of its top side 72 and bottom side 70 in an upward-facing or downward-facing configuration and need not be limited to the orientations depicted within the figures. The lid or base 40 disclosed herein may be adapted to be connected to the upper end of the sidewall of a canister or container, as described above. Further the minimum or inner venting radius 90 of any of the pressure relief features 42 of FIGS. 1-16 may be greater than about 5% of the total radius 86 from the longitudinal axis 50, or greater than about 10% of the total radius 86 from the longitudinal axis 50, or greater than about 15% of the total radius 86 from the longitudinal axis 50, or greater than about 20% of the total radius 86 from the longitudinal axis 50.

Referring to FIGS. 24A-27B, any of the thinned regions 80 discussed above may have a region thickness 82 that is less than about 10% of the central wall thickness 68, or a region thickness 82 that is less than about 15% of the central wall thickness 68, or a region thickness 82 that is less than about 25% of the central wall thickness 68, or a region thickness 82 that is less than about 30% of the central wall thickness 68, or a region thickness 82 that is less than about 35% of the central wall thickness 68, or a region thickness 82 that is less than about 40% of the central wall thickness 68. The region thickness 82 may be adjusted based on a desired performance of the pressure relief feature 42.

Still referring to FIGS. 24A-27B, various profiles of the pressure relief features 42 are shown, which are configured to provide for varying, controlled, and targeted pressure relief when a maximum pressure threshold has been achieved within a container or canister to which the lid or base 40 has been applied. More particularly, the various profiles of the pressure relief feature 42 define notches that have been cut out or otherwise removed from the central wall 48. A first or trapezoidal profile 110 is shown in FIGS. 17A and 17B, a second or triangular profile 112 is shown in FIGS. 18A and 18B, a third or rectangular profile 114 is shown in FIGS. 19A and 19B, and a fourth or rounded profile 116 is shown in FIGS. 20A and 20B. Referring to FIGS. 17A and 17B, the trapezoidal profile 110 is shown, which includes a first leg or segment 120, a second leg or segment 122, and a third leg or segment 124 that combine to define the trapezoidal profile 110. The thinned region 80 is also shown in more detail and is disposed between the inner surface 70 and the outer surface 72 of the central wall 48. The thinned region 80 creates a membrane or rupture wall that is configured to rupture at a particular pressure threshold.

Referring now to FIGS. 18A and 18B, a second or triangular profile 112 is shown, which includes the first leg or segment 120 and the second leg or segment 122, which intersect at a vertex 128. The thinned region 80 of the second profile 112 is defined between the outer surface 72 of the central wall 48 and the vertex 128. Referring to FIGS. 19A and 19B, the third or rectangular profile 114 is shown, which includes the first leg or segment 120, the second leg or segment 122, and the third leg or segment 124. The first segment 120 and the third segment 124 intersect to define a right angle, and the second segment 122 and the third segment 124 intersect to define a right angle. The thinned region 80 of the third profile 114 is defined between the outer surface 72 of the central wall 48 and the third segment 124. Referring to FIGS. 20A and 20B, the fourth or rounded profile 116 is shown, which includes the first segment 120, the second segment 122, and the third segment 124. The first segment 120 and the second segment 122 are generally straight, while the third segment 124 is generally rounded or semi-circular. The thinned region 80 further comprises a width 130. The thinned region 80 defines a constant thickness along the width 130 of the third profile 114, but the thickness of the thinned region 80 of the first profile 110, the second profile 112, and the fourth profile 116 varies along the widths 130 thereof due to the geometry of the various profiles.

While the lid or base 40 of the present disclosure is configured for attachment to a cylindrical container, it is contemplated that the lid or base 40 may take varying forms, and may have a cross-section that is prismatic, rectangular, or cubic. To that end, the line segment 86 as disclosed herein may reference the distance from the longitudinal axis 50 of the lid or base 40 to the outermost surface 88 of the outer wall 44 of the lid or base 40. In embodiments that include a prismatic, rectangular, or cubic cross-section, the length of the line segment 86 may vary about the longitudinal axis 50, while in the present embodiment, the radius 86 is identical about the longitudinal axis 50 since the lid or base 40 defines a circular cross section. While the lid or base 40 of the present embodiment is radially symmetric, prismatic, rectangular, or cubic containers may be symmetric about one, two, three, four, or more planes that intersect the longitudinal axis 50.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like. Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The claims are to be construed to include alternative embodiments to the extent permitted by the prior art.

It will be appreciated by those skilled in the art that while the embodiments of the present disclosure have been described in connection with particular embodiments and examples, the disclosure is not necessarily so limited, and that numerous other embodiments, examples, uses, modifications and departures from the embodiments, examples, and uses are intended to be encompassed by the claims attached hereto. Various features and advantages of the invention are set forth in the following claims.

We claim:

1. A venting system, comprising:

a lid or base comprising a center wall that defines a central longitudinal axis, and a total radius that is measured from the longitudinal axis to an outermost surface of the lid or base; and a pressure relief feature that is disposed along the lid or base, wherein the pressure relief feature includes at least a first venting feature defining a thinned region of the lid or base, wherein a venting radius is measured from the longitudinal axis to an outermost extent of the first venting feature, wherein the venting radius is between about 5% and about 25% of the total radius of the lid or base, expressed as a percentage, and wherein a thickness of the thinned region varies along the first venting feature.

2. The venting system of claim 1, wherein the pressure relief feature further includes a second venting feature that also defines a thinned region of the lid or base, and wherein the first venting feature and the second venting feature are disconnected.

3. The venting system of claim 2, wherein the first venting feature and the second venting feature are concavely shaped with respect to the longitudinal axis.

4. The venting system of claim 2, wherein the first venting feature and the second venting feature are convexly shaped with respect to the longitudinal axis.

5. The venting system of claim 2, wherein the first venting feature is a mirror image of the second venting feature.

6. The venting system of claim 5, wherein the first venting feature and the second venting feature define a v-shape.

7. The venting system of claim 2 further comprising a third venting feature that also defines a thinned region of the lid or base.

8. The venting system of claim 7, wherein the first venting feature, the second venting feature, and the third venting feature define a v-shape.

9. The venting system of claim 1, wherein the first venting feature consists of a circular notch that is disposed only on an inner side of the lid or base.

10. The venting system of claim 1, wherein the venting radius is between about 10% and about 22% of the total radius of the lid or base.

11. A venting system, comprising:

a lid or base comprising a center wall that defines a central longitudinal axis, and a total radius that is measured from the longitudinal axis to an outermost periphery of the lid or base; and a pressure relief feature that is disposed along the lid or base, wherein the pressure relief feature includes at least a first venting feature defining a thinned region of the lid or base, wherein a venting radius is measured from the longitudinal axis to an outermost extent of the first venting feature, wherein the venting radius is less than about 40% of the total radius of the lid or base, expressed as a percentage, wherein the thinned region defines a region thickness that is less than about 40% of a maximum thickness of the central wall, expressed as a percentage, and wherein the pressure relief feature further includes a second venting feature that is disconnected from the first venting feature.

12. The venting system of claim 11, wherein the first venting feature and the second venting feature are mirror images of one another.

13. The venting system of claim 11, wherein the first venting feature and the second venting feature define curved segments.

14. The venting system of claim 11, wherein the first venting feature and the second venting feature define a v-shape.

15. The venting system of claim 11, wherein the pressure relief feature further includes a third venting feature.

16. The venting system of claim 11, wherein the thinned region extends through the central longitudinal axis.

17. The venting system of claim 16, wherein the first venting feature defines an s-shape.

18. The venting system of claim 11, wherein a minimum venting distance of the pressure relief feature is less than about 20% of the total radius of the lid or base.

19. The venting system of claim 11, wherein a minimum venting distance of the pressure relief feature is less than about 50% of the total radius of the lid or base.

20. The venting system of claim 11, wherein a thickness of the thinned region varies along the first venting feature.

* * * * *